US012714188B2

(12) United States Patent
Pratt et al.

(10) Patent No.: US 12,714,188 B2
(45) **Date of Patent: *Aug. 25, 2026**

(54) RAPID-ENTRY FOOTWEAR HAVING AN EXPANDABLE OPENING

(71) Applicant: FAST IP, LLC, Vineyard, UT (US)

(72) Inventors: Michael Pratt, Alpine, UT (US); Steven Hermann, Eagle Mountain, UT (US); Joseph Eddington, American Fork, UT (US); Craig Cheney, Lindon, UT (US)

(73) Assignee: FAST IP, LLC, Lindon, UT (US)

( * ) Notice: Subject to any disclaimer, the term of this patent is extended or adjusted under 35 U.S.C. 154(b) by 493 days.

This patent is subject to a terminal disclaimer.

(21) Appl. No.: 17/367,987

(22) Filed: Jul. 6, 2021

(65) Prior Publication Data

US 2021/0330033 A1 Oct. 28, 2021

Related U.S. Application Data

(63) Continuation of application No. PCT/US2019/069110, filed on Dec. 31, 2019.
(Continued)

(51) Int. Cl.

| | |
|---|---|
| ***A43B 13/14*** | (2006.01) |
| ***A43B 3/24*** | (2006.01) |
| ***A43B 11/00*** | (2006.01) |
| ***A43B 13/00*** | (2006.01) |
| ***A43B 23/02*** | (2006.01) |
| ***A43C 11/00*** | (2006.01) |

(52) U.S. Cl.
CPC ..... *A43B 13/141* (2013.01); *A43B 3/248* (2013.01); *A43B 11/00* (2013.01); *A43B 13/00* (2013.01); *A43B 13/14* (2013.01); *A43B 23/027* (2013.01); *A43C 11/002* (2013.01); *A43C 11/008* (2013.01)

(58) Field of Classification Search
CPC ..... A43B 13/141; A43B 13/14; A43B 11/00; A43B 23/0295; A43B 13/16; A43B 3/248; A43C 11/002
See application file for complete search history.

(56) References Cited

U.S. PATENT DOCUMENTS

| | | | |
|---|---|---|---|
| 112,439 | A | 3/1871 | Francis |
| 287,312 | A | 10/1883 | Packard |

(Continued)

FOREIGN PATENT DOCUMENTS

| | | | |
|---|---|---|---|
| CN | 1403041 | A | 3/2003 |
| CN | 201005111 | Y | 1/2008 |

(Continued)

OTHER PUBLICATIONS https://us.ecco.com/ecco-biom-fjuel-mens-outdoor-shoe-837594.html?dwvar_837594_color=00001 submitted herewith as of Jun. 1, 2016.

(Continued)

*Primary Examiner* — Grady Alexander Nunnery

(57) ABSTRACT

Footwear is disclosed herein that comprises a base with a cut-out and/or a fold pattern, either of which, when actuated, is useful to transform the footwear from a closed/relaxed configuration to an open/actuated configuration in which the rapid-entry shoe has an expanded shoe opening to facilitate reception of a foot of an individual wearing the rapid-entry shoe.

12 Claims, 22 Drawing Sheets

Related U.S. Application Data

(60) Provisional application No. 62/937,107, filed on Nov. 18, 2019, provisional application No. 62/789,395, filed on Jan. 7, 2019.

(56) References Cited

U.S. PATENT DOCUMENTS

| | | | |
|---|---|---|---|
| 736,156 | A | 8/1903 | Roberts |
| 808,948 | A | 1/1906 | Roberts |
| 827,330 | A | 7/1906 | Tillson |
| 863,549 | A | 8/1907 | Metz |
| 881,153 | A | 3/1908 | Rickert |
| 921,461 | A | 5/1909 | Rickert |
| 923,860 | A | 6/1909 | Kroell |
| 1,081,678 | A | 12/1913 | Langerak |
| 1,116,462 | A | 11/1914 | Moran |
| 1,266,620 | A | 5/1918 | Peabody |
| 1,464,342 | A | 8/1923 | Rothacher |
| 1,494,236 | A | 5/1924 | Greathouse |
| 1,686,175 | A | 10/1928 | Read |
| 1,926,818 | A | 9/1933 | Rateliff |
| 2,069,752 | A | 2/1937 | Dorr |
| 2,083,390 | A | 6/1937 | Murena |
| 2,118,019 | A | 5/1938 | Benjafield |
| 2,266,732 | A | 12/1941 | Babinchak |
| 2,297,594 | A | 9/1942 | Weinstat |
| 2,368,514 | A | 1/1945 | Baehr |
| 2,450,250 | A | 9/1948 | Napton |
| 2,452,502 | A | 10/1948 | Tarbox |
| 2,693,039 | A | 11/1954 | Balut |
| 2,736,110 | A | 2/1956 | Hardimon |
| 2,763,071 | A | 9/1956 | Kingsley |
| 2,829,448 | A | 4/1958 | Minera |
| 2,920,402 | A | 1/1960 | Minera |
| 3,000,116 | A | 9/1961 | Ally |
| 3,014,288 | A | 12/1961 | Evans et al. |
| 3,040,454 | A | 6/1962 | Topper et al. |
| 3,097,438 | A | 7/1963 | Evans |
| 3,146,535 | A | 9/1964 | Owings |
| 3,192,651 | A | 7/1965 | Smith |
| 3,373,512 | A | 3/1968 | Jacobson |
| 3,643,350 | A | 2/1972 | Paoletta et al. |
| 3,798,802 | A | 3/1974 | Saunders |
| 4,489,509 | A | 12/1984 | Libit |
| 4,590,690 | A | 5/1986 | Pfander |
| 4,596,080 | A | 6/1986 | Benoit et al. |
| 4,805,321 | A | 2/1989 | Tonkel |
| 4,811,502 | A | 3/1989 | Barret |
| 4,924,605 | A | 5/1990 | Spademan |
| 4,972,613 | A | 11/1990 | Loveder |
| 4,979,319 | A | 12/1990 | Hayes |
| 5,054,216 | A | 10/1991 | Lin |
| 5,090,140 | A | 2/1992 | Sessa |
| 5,127,170 | A | 7/1992 | Messina |
| 5,174,050 | A | 12/1992 | Gabrielli |
| 5,181,331 | A | 1/1993 | Berger |
| 5,184,410 | A | 2/1993 | Hamilton |
| 5,257,470 | A | 11/1993 | Auger et al. |
| 5,259,126 | A | 11/1993 | Rosen |
| 5,265,353 | A | 11/1993 | Marega et al. |
| 5,282,327 | A | 2/1994 | Ogle |
| 5,311,678 | A | 5/1994 | Spademan |
| 5,341,583 | A | 8/1994 | Hallenbeck |
| 5,351,583 | A | 10/1994 | Szymber et al. |
| 5,353,526 | A | 10/1994 | Foley et al. |
| 5,371,957 | A | 12/1994 | Gaudio |
| 5,430,961 | A | 7/1995 | Faulconer et al. |
| 5,467,537 | A | 11/1995 | Aveni et al. |
| 5,806,208 | A | 9/1998 | French |
| 5,842,292 | A | 12/1998 | Siesel |
| 5,846,063 | A | 12/1998 | Lakic |
| 5,983,530 | A | 11/1999 | Chou |
| 5,997,027 | A | 12/1999 | Jungkind |
| 6,000,148 | A | 12/1999 | Cretinon |
| 6,014,823 | A | 1/2000 | Lakic |
| 6,125,555 | A | 10/2000 | Schenkel |
| 6,128,837 | A | 10/2000 | Huang |
| 6,170,173 | B1 | 1/2001 | Caston |
| 6,189,239 | B1 * | 2/2001 | Gasparovic ..... A43B 13/141 36/102 |
| 6,290,559 | B1 | 9/2001 | Scott |
| 6,321,466 | B1 | 11/2001 | Bordin et al. |
| 6,360,454 | B1 | 3/2002 | Dachgruber et al. |
| 6,367,171 | B1 | 4/2002 | Burt |
| 6,378,230 | B1 | 4/2002 | Rotem et al. |
| 6,427,361 | B1 | 8/2002 | Chou |
| 6,470,537 | B1 | 10/2002 | Schallenkamp |
| 6,643,954 | B2 | 11/2003 | Voswinkel |
| 6,671,980 | B1 | 1/2004 | Liu |
| 6,684,533 | B1 | 2/2004 | Su |
| 6,839,985 | B2 | 1/2005 | Bettiol |
| 6,877,252 | B2 | 4/2005 | Wilkinson |
| 6,922,917 | B2 | 8/2005 | Kerns et al. |
| 6,925,732 | B1 | 8/2005 | Clarke |
| 6,938,361 | B2 | 9/2005 | Su |
| 7,059,068 | B2 | 6/2006 | Magallanes et al. |
| 7,103,994 | B2 | 9/2006 | Johnson |
| 7,178,270 | B2 | 2/2007 | Hurd et al. |
| 7,225,563 | B2 | 6/2007 | Chen et al. |
| 7,439,837 | B2 | 10/2008 | McDonald |
| D583,956 | S | 12/2008 | Chang et al. |
| 7,661,205 | B2 | 2/2010 | Johnson |
| 7,685,747 | B1 | 3/2010 | Gasparovic et al. |
| 7,757,414 | B2 | 7/2010 | Tonkel |
| 7,793,438 | B1 | 9/2010 | Busse et al. |
| 7,823,299 | B1 | 11/2010 | Brigham |
| D648,512 | S | 11/2011 | Schlageter et al. |
| 8,065,819 | B2 | 11/2011 | Kaufman |
| 8,161,669 | B2 | 4/2012 | Keating |
| 8,225,535 | B2 | 7/2012 | Dillenbeck |
| 8,302,329 | B2 | 11/2012 | Hurd et al. |
| 8,333,021 | B2 | 12/2012 | Johnson |
| 8,745,901 | B2 | 6/2014 | Toraya |
| 8,769,845 | B2 | 7/2014 | Lin |
| 9,119,441 | B2 | 9/2015 | Frappier |
| 9,314,067 | B2 | 4/2016 | Bock |
| 9,351,532 | B2 | 5/2016 | Mokos |
| 9,615,624 | B2 | 4/2017 | Kilgore et al. |
| 9,629,416 | B2 | 4/2017 | Rackiewicz et al. |
| 9,635,905 | B2 | 5/2017 | Dekovic |
| 9,675,132 | B2 | 6/2017 | Marshall |
| 9,717,304 | B2 | 8/2017 | Bernhard et al. |
| 9,820,527 | B2 | 11/2017 | Pratt et al. |
| 9,999,278 | B2 | 6/2018 | Feinstein |
| 10,327,515 | B2 | 6/2019 | Peyton et al. |
| D854,303 | S | 7/2019 | Flanagan et al. |
| 10,455,898 | B1 | 10/2019 | Orand et al. |
| 10,499,707 | B2 | 12/2019 | Hobson et al. |
| 10,506,842 | B2 | 12/2019 | Pratt et al. |
| 10,537,154 | B2 | 1/2020 | Smith et al. |
| 10,568,382 | B2 | 2/2020 | Hatfield et al. |
| 10,609,981 | B1 | 4/2020 | Phinney |
| 10,617,174 | B1 | 4/2020 | Hopkins et al. |
| 10,638,810 | B1 | 5/2020 | Cheney et al. |
| 10,653,209 | B2 | 5/2020 | Pratt et al. |
| 10,660,401 | B1 | 5/2020 | Pratt et al. |
| 10,765,167 | B2 | 9/2020 | Azoulay et al. |
| 10,791,796 | B1 | 10/2020 | Baker |
| 10,813,405 | B2 | 10/2020 | Pratt |
| 10,905,192 | B1 | 2/2021 | Cheney |
| 10,912,348 | B2 | 2/2021 | Owings et al. |
| 10,973,278 | B2 | 4/2021 | Raia |
| 11,000,091 | B1 | 5/2021 | Kyle |
| 11,140,941 | B2 | 10/2021 | Xanthos et al. |
| 11,154,113 | B2 | 10/2021 | Hatfield et al. |
| 11,172,727 | B2 | 11/2021 | Hatfield et al. |
| 11,191,320 | B2 | 12/2021 | Happen |
| 11,213,098 | B2 | 1/2022 | Beers et al. |
| 11,234,482 | B2 | 2/2022 | Roser |
| D948,190 | S | 4/2022 | Jury |
| D948,191 | S | 4/2022 | Holmes |
| D949,540 | S | 4/2022 | Jury |
| D949,544 | S | 4/2022 | Witherow |
| D955,732 | S | 6/2022 | Kelley |

(56) References Cited

U.S. PATENT DOCUMENTS 11,633,005 B2 4/2023 Pratt et al.
11,633,006 B2 4/2023 Pratt et al.
11,633,016 B2 4/2023 Orand et al.
11,659,886 B2 5/2023 Cheney et al.
11,700,916 B2 7/2023 Kilgore et al.
11,707,113 B2 7/2023 Hopkins et al.
D993,601 S 8/2023 Wang et al.
11,737,511 B2 8/2023 Cheney et al.
11,744,319 B2 9/2023 Farina
2001/0001350 A1 5/2001 Aguerre
2002/0053147 A1 5/2002 Borsoi et al.
2002/0066213 A1 6/2002 Wells
2002/0095823 A1 7/2002 Laio et al.
2002/0144434 A1 10/2002 Farys et al.
2002/0174568 A1 11/2002 Neiley
2003/0106244 A1 6/2003 Miller et al.
2004/0003517 A1 1/2004 Marvin et al.
2004/0088890 A1 5/2004 Matis et al.
2004/0111921 A1 6/2004 Lenormand
2005/0022428 A1 2/2005 Anderson
2005/0034328 A1 2/2005 Geer
2005/0039348 A1 2/2005 Raluy et al.
2005/0066543 A1 3/2005 Rosen et al.
2005/0198867 A1 9/2005 Labbe
2005/0241189 A1 11/2005 Elkington et al.
2007/0074425 A1 4/2007 Leong
2007/0180730 A1 8/2007 Greene et al.
2007/0209234 A1 9/2007 Chou
2007/0256329 A1 11/2007 Antonelli et al.
2007/0271822 A1 11/2007 Meschter
2007/0277394 A1 12/2007 Hansen et al.
2008/0086911 A1 4/2008 Labbe
2008/0189984 A1 8/2008 Januszewski et al.
2008/0276492 A1 11/2008 Burnett
2008/0307673 A1 12/2008 Johnson
2008/0313929 A1 12/2008 Hoyt
2009/0090026 A1 4/2009 Mosher
2010/0037483 A1 2/2010 Meschter et al.
2010/0095494 A1 4/2010 Martin
2010/0095554 A1 4/2010 Gillespie
2010/0251572 A1 10/2010 Baudouin et al.
2011/0016751 A1 1/2011 Somerville
2011/0146106 A1 6/2011 Kaufman
2011/0185592 A1 8/2011 Nishiwaki et al.
2011/0214313 A1 9/2011 James et al.
2011/0239489 A1 10/2011 Iuchi et al.
2011/0277350 A1 11/2011 Huynh
2012/0055044 A1 3/2012 Dojan et al.
2012/0060395 A1 3/2012 Blevens et al.
2012/0151799 A1 6/2012 Weinreb
2012/0167413 A1 7/2012 Marvin et al.
2012/0216429 A1 8/2012 Bastida et al.
2012/0317839 A1 12/2012 Pratt
2013/0160328 A1 6/2013 Hatfield et al.
2013/0185959 A1 7/2013 Coleman
2013/0219747 A1 8/2013 Lederer
2013/0312285 A1 11/2013 Sharma et al.
2014/0013624 A1 1/2014 Stockbridge et al.
2014/0090274 A1 4/2014 Arquilla
2014/0101975 A1 4/2014 Ueda
2014/0123516 A1 5/2014 Cressman et al.
2014/0173932 A1 6/2014 Bell
2014/0189964 A1 7/2014 Wen et al.
2014/0202044 A1 7/2014 Adami et al.
2014/0259781 A1 9/2014 Sakai
2014/0305005 A1 10/2014 Yeh
2014/0373396 A1 12/2014 Chang
2015/0013184 A1 1/2015 Beers
2015/0013189 A1 1/2015 Hanak et al.
2015/0020416 A1 1/2015 Wiens
2015/0047222 A1 2/2015 Rushbrook
2015/0047223 A1 2/2015 Flinterman et al.
2015/0165338 A1 6/2015 Choe
2015/0216252 A1 8/2015 Wiens
2015/0305432 A1 10/2015 Wiens
2015/0305442 A1 10/2015 Ravindran
2016/0007674 A1 1/2016 Labonte et al.
2016/0128424 A1 5/2016 Connell et al.
2016/0128429 A1 5/2016 Hatfield et al.
2016/0262492 A1 9/2016 Fujita et al.
2016/0302530 A1 10/2016 Smith et al.
2016/0374427 A1 12/2016 Zahabian
2017/0013915 A1 1/2017 Caston, Jr.
2017/0035148 A1 2/2017 Marvin et al.
2017/0127755 A1 5/2017 Bunnell et al.
2017/0215525 A1 8/2017 Labbe
2017/0265562 A1 9/2017 Mullen
2017/0360143 A1 12/2017 Pratt et al.
2017/0360151 A1 12/2017 Pratt
2018/0110287 A1* 4/2018 Hopkins ..... A43B 23/0245
2018/0110292 A1 4/2018 Beers et al.
2018/0199659 A1 7/2018 Lintaman
2018/0235314 A1 8/2018 Farage
2018/0255865 A1 9/2018 Hsu
2018/0263332 A1 9/2018 Bruno
2018/0289109 A1 10/2018 Beers et al.
2018/0295942 A1 10/2018 Drake
2018/0338572 A1 11/2018 Cross et al.
2018/0343968 A1 12/2018 James et al.
2019/0053571 A1 2/2019 Bjornson et al.
2019/0116916 A1 4/2019 Burch
2019/0281920 A1 9/2019 Ito et al.
2019/0289960 A1 9/2019 Loveder
2019/0297999 A1 10/2019 Nakaya et al.
2019/0307208 A1 10/2019 Corcoran-Tadd et al.
2019/0365029 A1 12/2019 Cross et al.
2019/0366667 A1 12/2019 Cross et al.
2020/0015544 A1 1/2020 Pratt
2020/0037703 A1 2/2020 Twist
2020/0046066 A1 2/2020 Difrancisco
2020/0068991 A1 3/2020 Steere et al.
2020/0085136 A1 3/2020 Pratt et al.
2020/0113274 A1 4/2020 Butler
2020/0187590 A1 6/2020 Hopkins et al.
2020/0196703 A1 6/2020 Hopkins
2020/0196787 A1 6/2020 Dament et al.
2020/0205511 A1 7/2020 Hopkins et al.
2020/0205512 A1 7/2020 Blanche et al.
2020/0205516 A1 7/2020 Kilgore
2020/0205518 A1 7/2020 Hopkins et al.
2020/0205520 A1 7/2020 Kilgore
2020/0245797 A1 8/2020 Kim
2020/0253333 A1 8/2020 Kilgore et al.
2020/0305552 A1 10/2020 Cheney et al.
2020/0323308 A1 10/2020 Dubuisson
2020/0375319 A1 12/2020 Yang
2020/0383424 A1 12/2020 Hughes
2021/0059351 A1 3/2021 Piacentini
2021/0068493 A1 3/2021 Pratt et al.
2021/0068494 A1 3/2021 Zahabian
2021/0068498 A1 3/2021 Cheney et al.
2021/0106094 A1 4/2021 Cheney
2021/0112911 A1 4/2021 Pratt et al.
2021/0112914 A1 4/2021 Cheney
2021/0112916 A1 4/2021 Schulten
2021/0127788 A1 5/2021 Li
2021/0145114 A1 5/2021 Kyle
2021/0169177 A1 6/2021 Yang
2021/0186146 A1 6/2021 Erwin
2021/0204642 A1 7/2021 Kyle
2021/0204643 A1 7/2021 Kyle
2021/0204644 A1 7/2021 Kyle
2021/0204645 A1 7/2021 Pratt
2021/0227923 A1 7/2021 Love et al.
2021/0282495 A1 9/2021 Davis et al.
2021/0321718 A1 10/2021 Chang
2021/0337922 A1 11/2021 Cheney
2021/0345727 A1 11/2021 Raia
2022/0142291 A1 5/2022 Cheney et al.
2022/0240625 A1 8/2022 Shin
2022/0287406 A1 9/2022 Cheney et al.
2022/0287407 A1 9/2022 Cheney et al.
2022/0354220 A1 11/2022 Cheney
2022/0361627 A1 11/2022 Cheney et al.

(56) References Cited

U.S. PATENT DOCUMENTS

| | | | |
|---|---|---|---|
| 2022/0369758 | A1 | 11/2022 | Pratt |
| 2022/0378144 | A1 | 12/2022 | Pratt et al. |
| 2022/0400810 | A1 | 12/2022 | Cheney et al. |
| 2023/0030016 | A1 | 2/2023 | Pratt et al. |
| 2023/0033366 | A1 | 2/2023 | Farina |
| 2023/0035573 | A1 | 2/2023 | Bar |
| 2023/0052916 | A1 | 2/2023 | Bar |
| 2023/0055164 | A1 | 2/2023 | Cheney et al. |
| 2023/0081272 | A1 | 3/2023 | Pratt |
| 2023/0084256 | A1 | 3/2023 | Brilliant |
| 2023/0218033 | A1 | 7/2023 | Cheney |
| 2023/0225450 | A1 | 7/2023 | Cheney et al. |
| 2023/0263270 | A1 | 8/2023 | Jones |
| 2023/0276897 | A1 | 9/2023 | Cheney et al. |
| 2023/0284737 | A1 | 9/2023 | Bar |

FOREIGN PATENT DOCUMENTS

| | | | | |
|---|---|---|---|---|
| CN | 101991227 | A | 3/2011 | |
| CN | 107467775 | A | 12/2017 | |
| DE | 19534249 | A1 | 3/1997 | |
| DE | 19611797 | U1 | 10/1997 | |
| DE | 29809404 | A1 | 8/1998 | |
| DE | 10247163 | A1 | 4/2004 | |
| DE | 102004005288 | A1 | 8/2005 | |
| EP | 1059044 | A1 | 12/2000 | |
| EP | 1952715 | A1 | 8/2008 | |
| EP | 3266327 | A1 | 1/2018 | |
| FR | 3066679 | A1 | 11/2018 | |
| GB | 2517399 | A | 2/2015 | |
| JP | 11-127907 | A | 5/1999 | |
| JP | 2001-149394 | A | 6/2001 | |
| JP | 2010-104416 | A | 5/2010 | |
| JP | 2014-161721 | A | 9/2014 | |
| KR | 10-2005-0095542 | A | 9/2005 | |
| KR | 10-2009-0093548 | A | 9/2009 | |
| KR | 10-2009-0130804 | A | 12/2009 | |
| KR | 10-0936510 | B1 | 1/2010 | |
| NL | 2000762 | C1 | 1/2009 | |
| WO | WO-2007048678 | A1 * | 5/2007 | ..... A43B 1/0018 |
| WO | 2007/080205 | A1 | 7/2007 | |
| WO | 2009/089572 | A1 | 7/2009 | |
| WO | 2009/154350 | A1 | 12/2009 | |
| WO | 2017/004135 | A2 | 1/2017 | |
| WO | 2018/230961 | A1 | 12/2018 | |
| WO | 2019/215359 | A1 | 11/2019 | |
| WO | 2020/176653 | A1 | 9/2020 | |
| WO | 2021/162569 | A1 | 8/2021 | |
| WO | 2022/221339 | A1 | 10/2022 | |
| WO | 2023/049414 | A1 | 3/2023 | |
| WO | 2023/064568 | A1 | 4/2023 | |

OTHER PUBLICATIONS https://www.teva.com/kids-sandals/hurricane-drift/ 1102483C.html submitted herewith as of Jun. 13, 2019.

Sneider, "Kizik Handsfree New York Shoe Review," https://the-gadgeteer.com/2018/06/27/kizik-handsfree-new-york-show-review/ (2018).

U.S. Provisional Application filed Jun. 29, 2015 by Zahabian., U.S. Appl. No. 62/186,148.

* cited by examiner

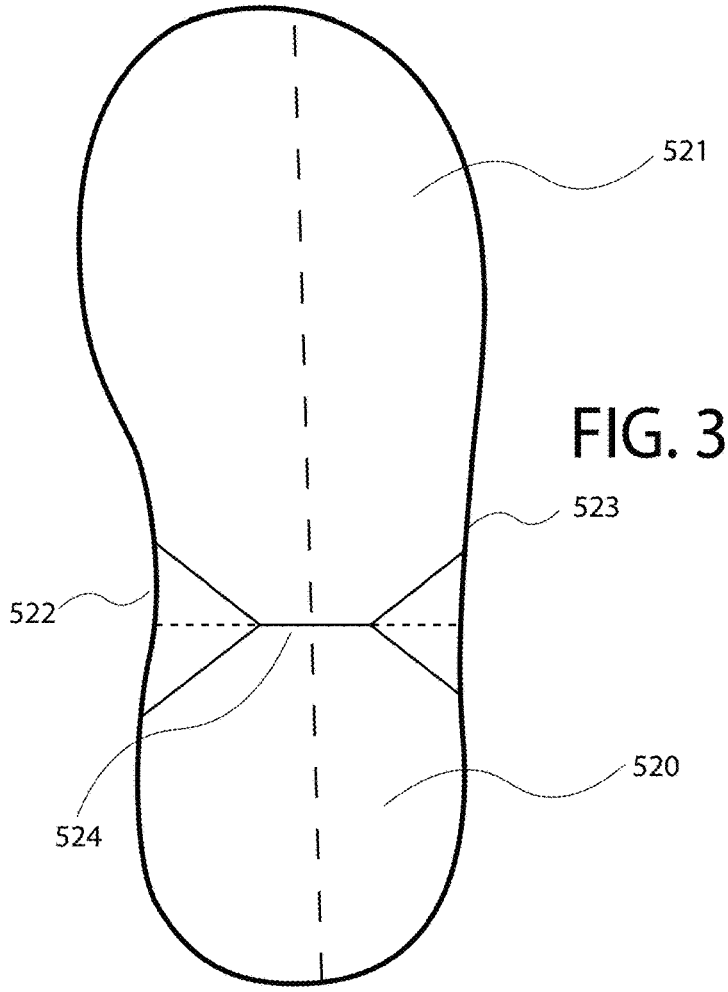
FIG. 3A.1
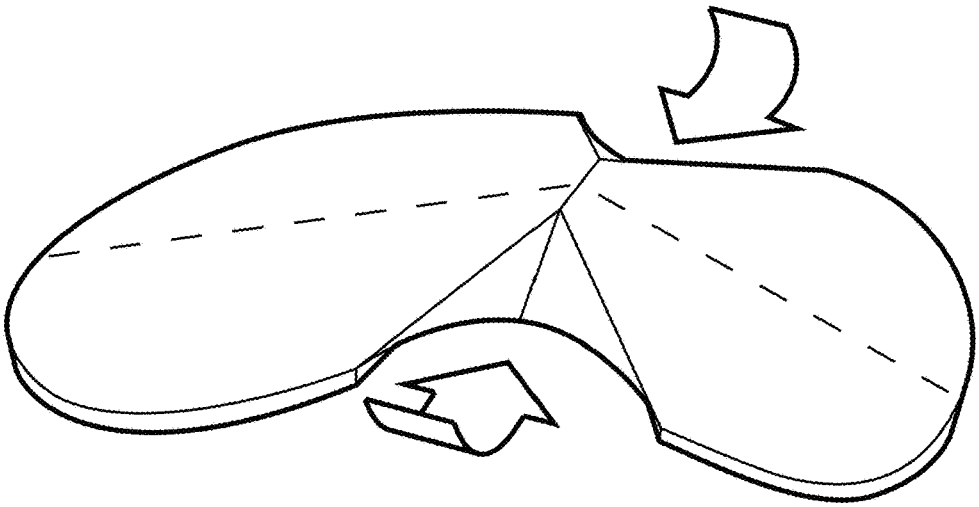
FIG. 3A.2

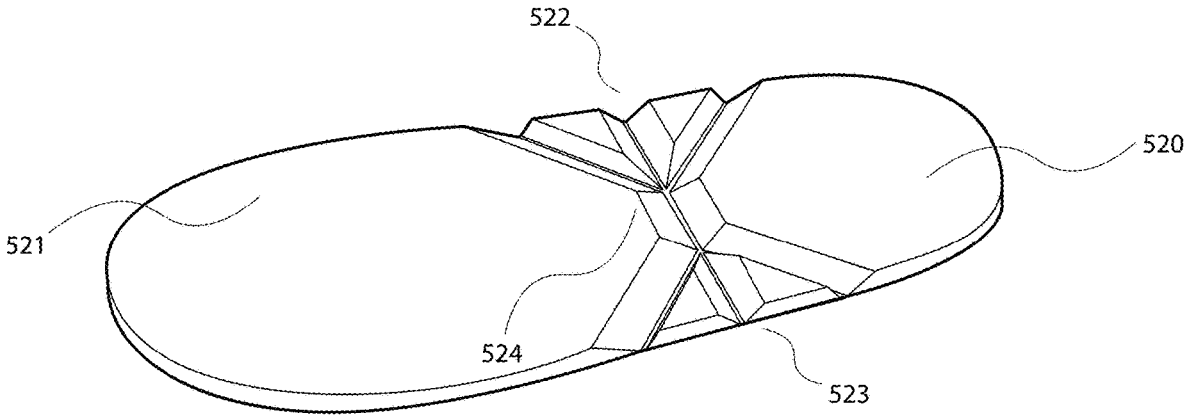
FIG. 3B.1
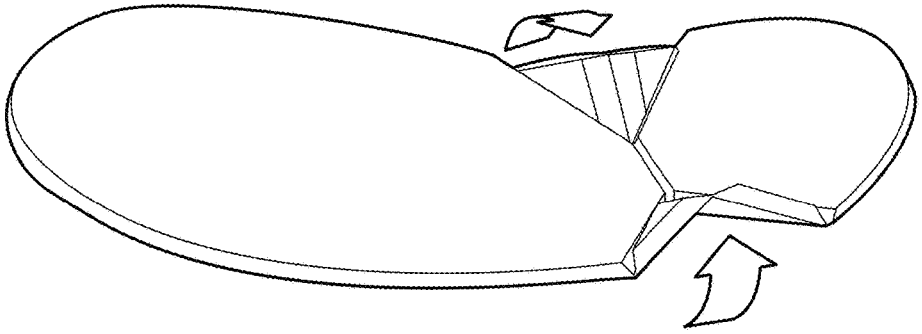
FIG. 3B.2

FIG. 4A.1
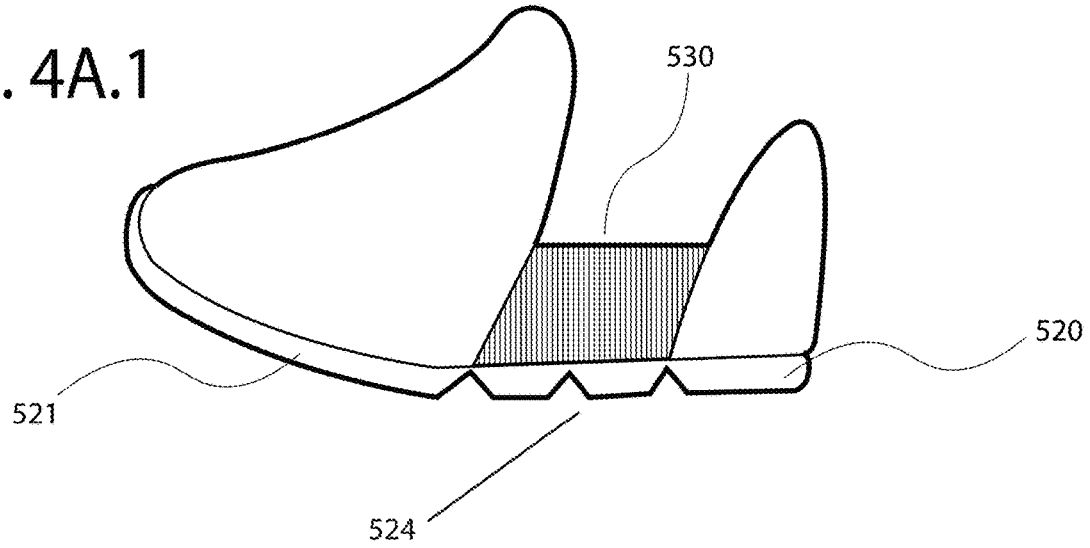
FIG. 4A.2
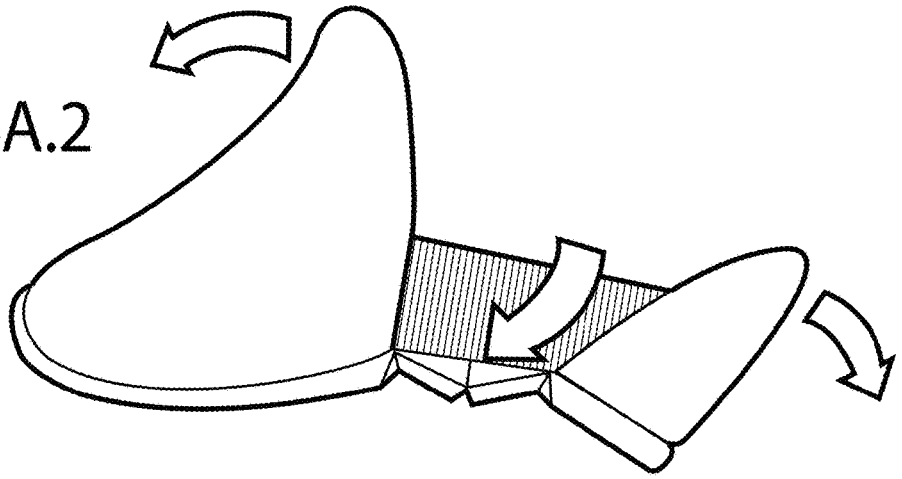

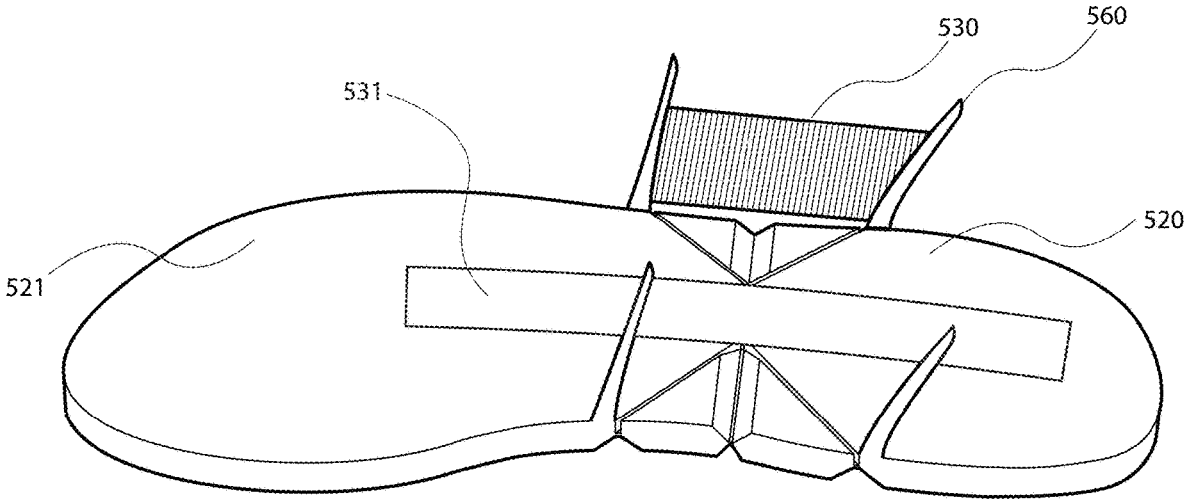
FIG. 4B.1
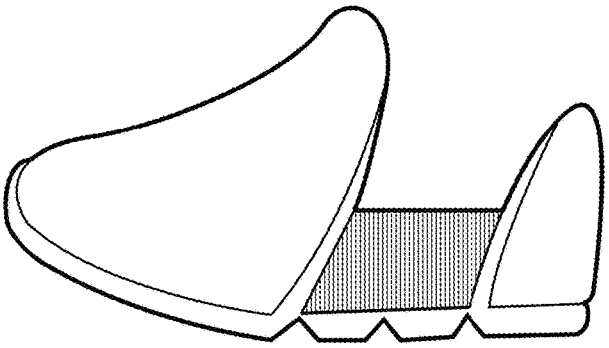
FIG. 4B.2
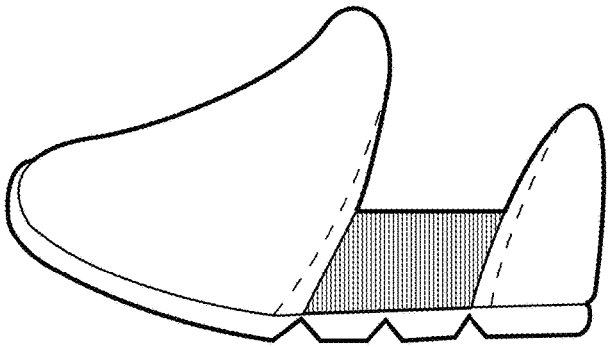
FIG. 4B.3

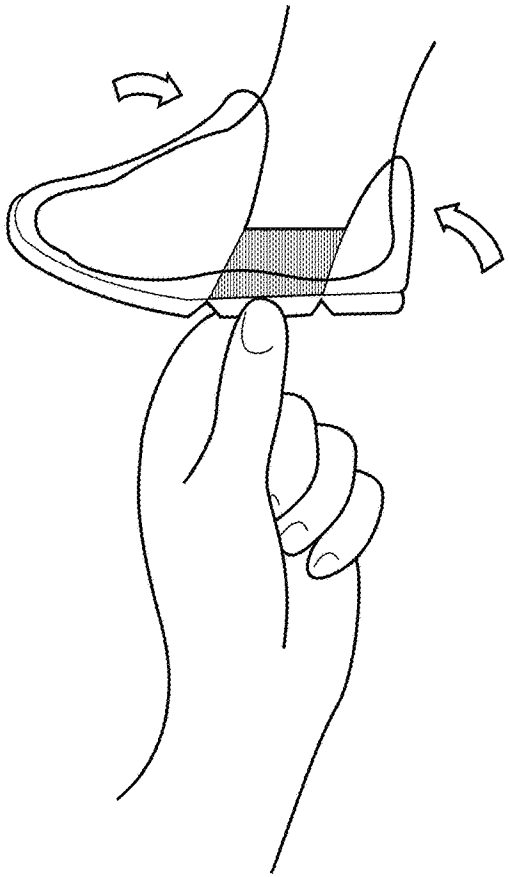
FIG. 4C.3
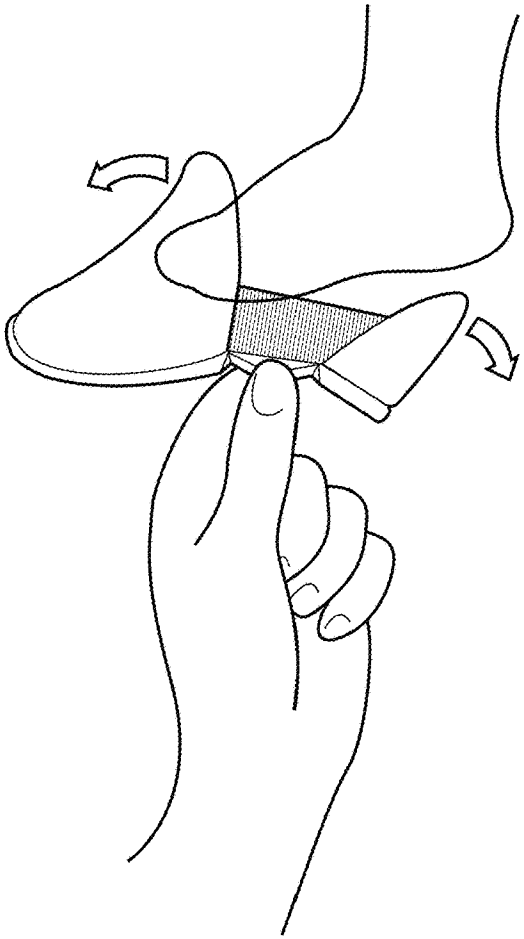
FIG. 4C.2
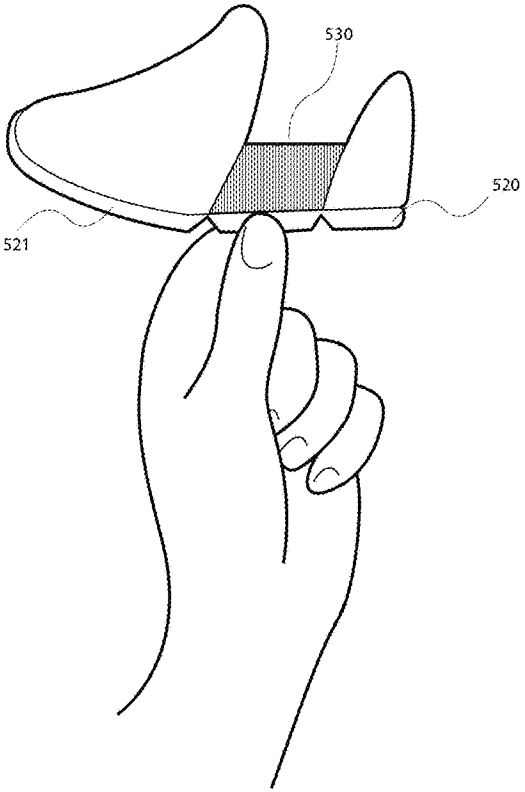
FIG. 4C.1

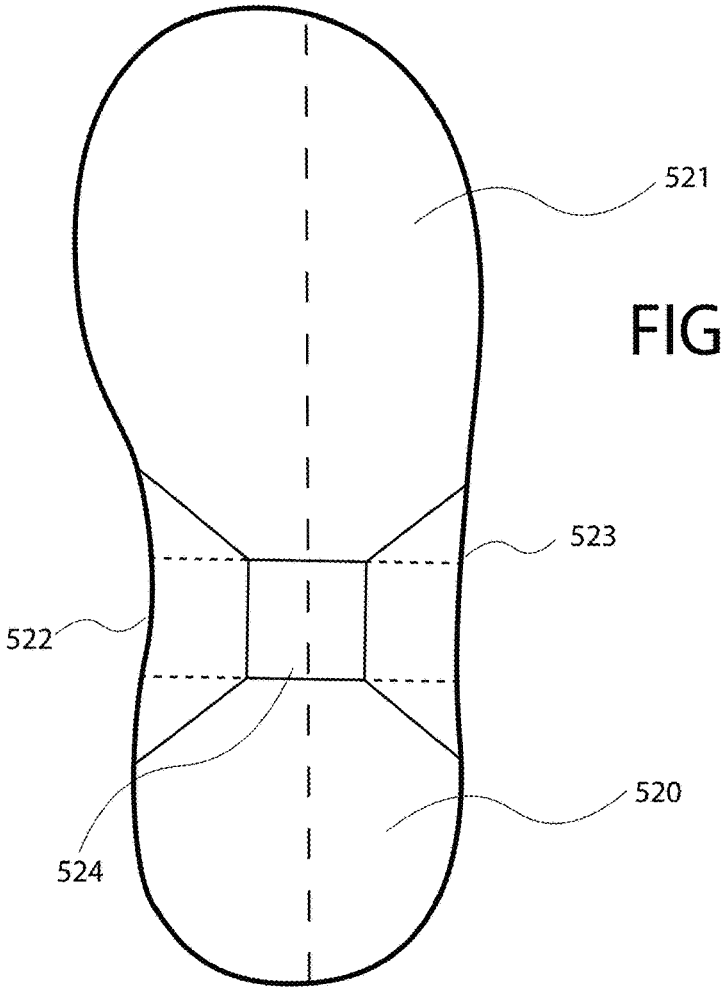
FIG. 5A.1
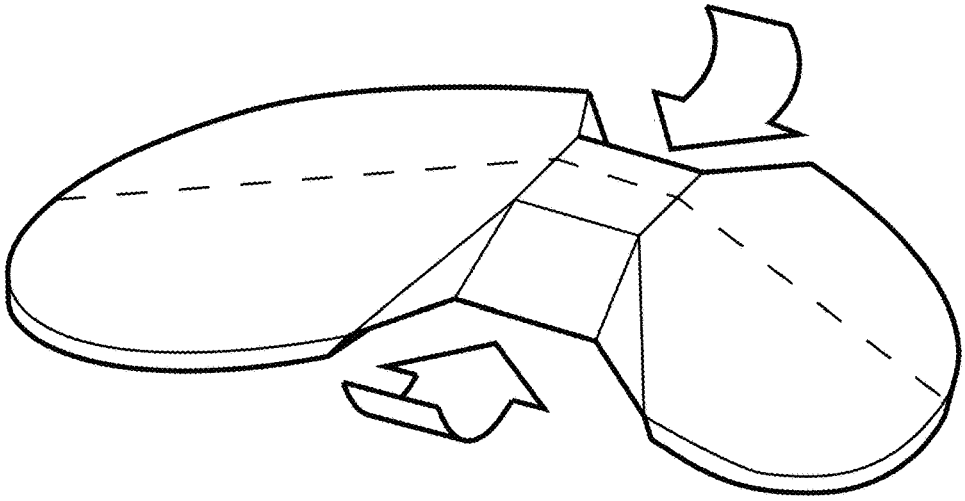
FIG. 5A.2

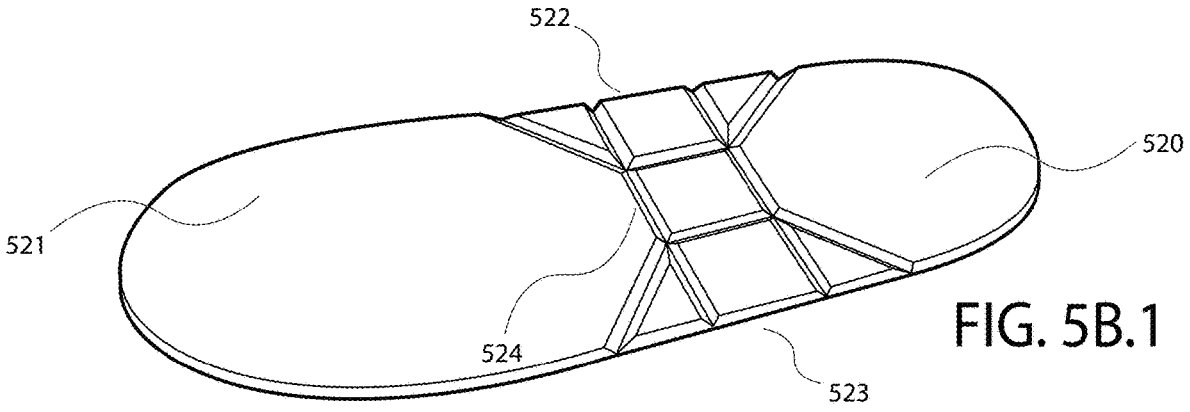
FIG. 5B.1
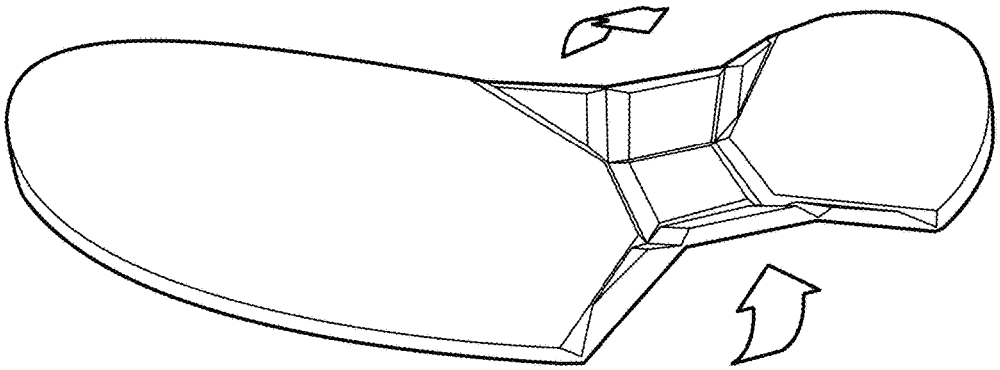
FIG. 5B.2

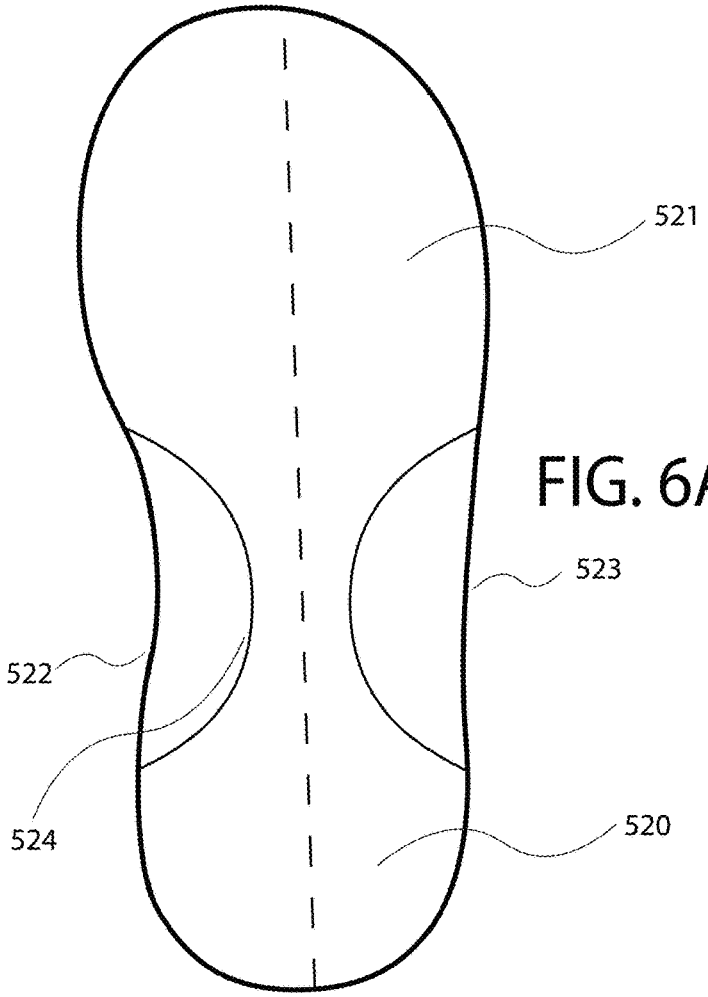
FIG. 6A.1
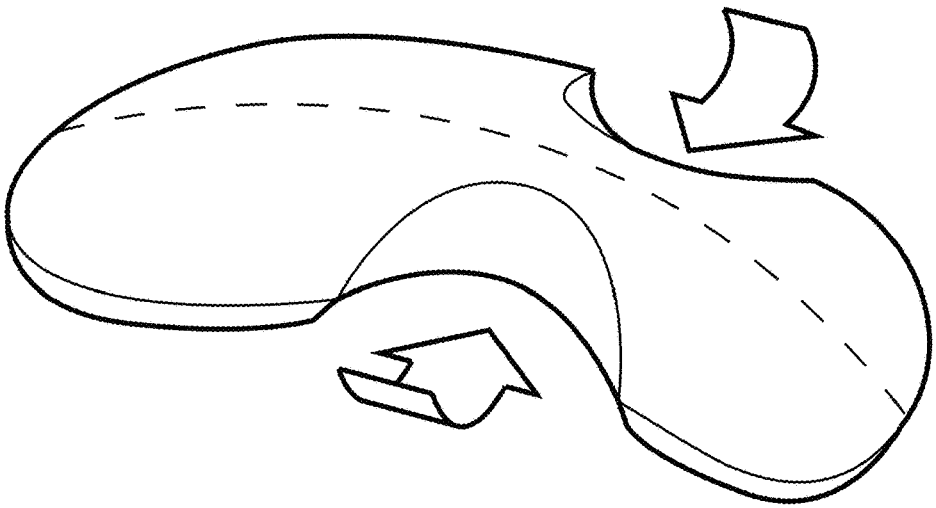
FIG. 6A.2

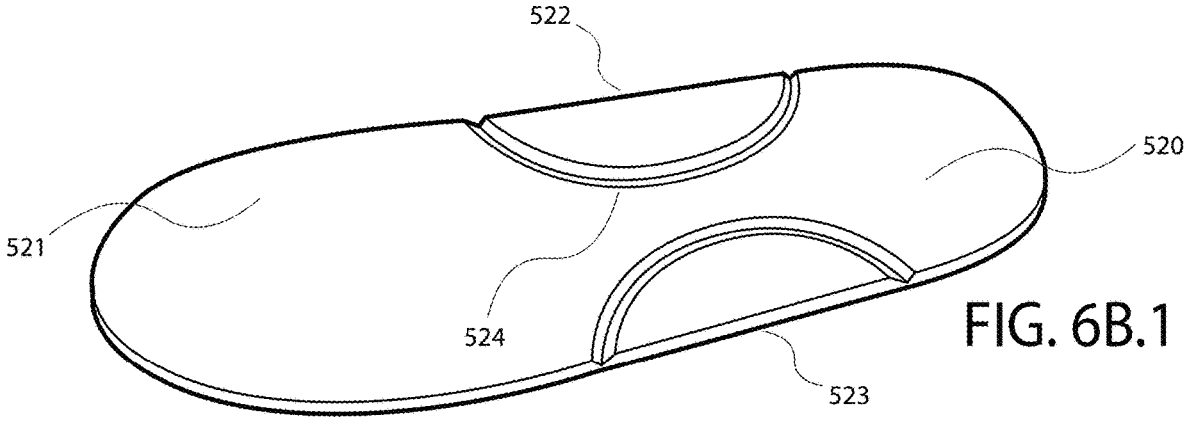
FIG. 6B.1
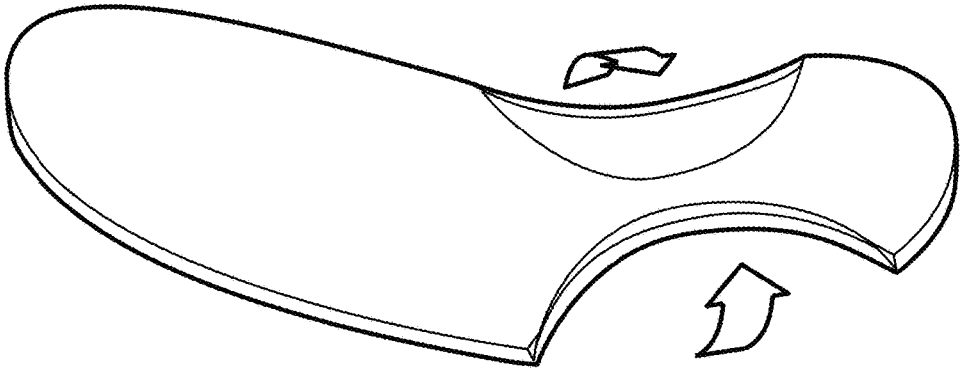
FIG. 6B.2

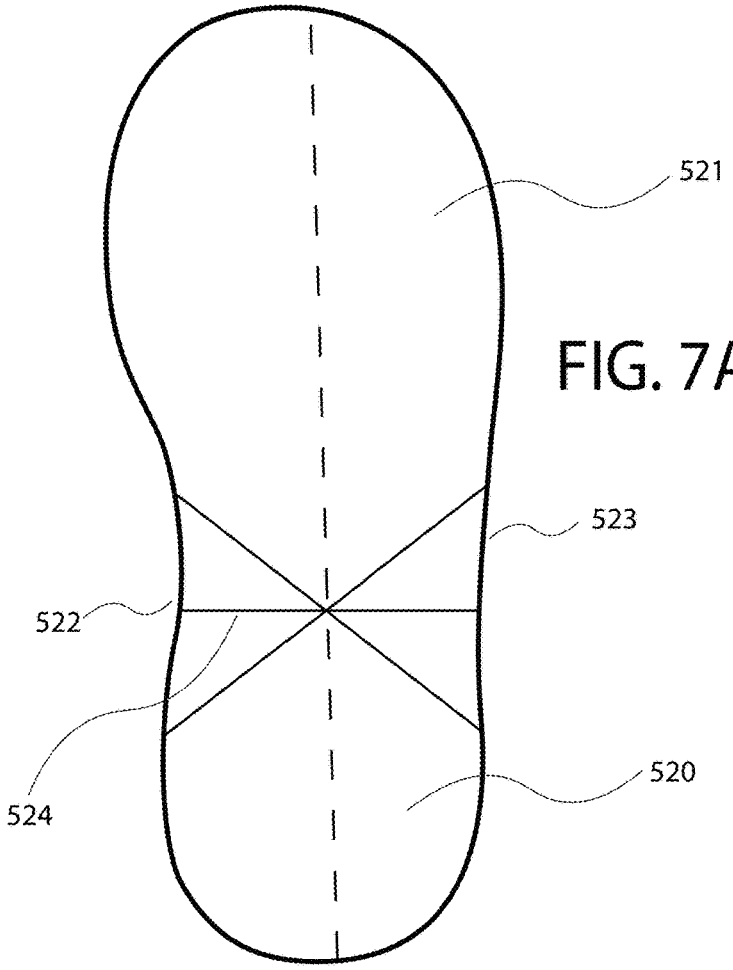
FIG. 7A.1
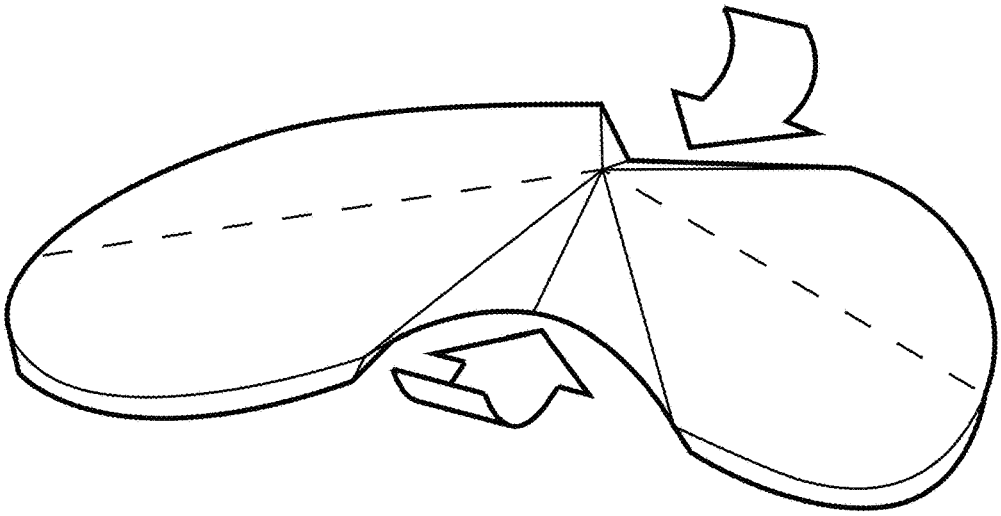
FIG. 7A.2

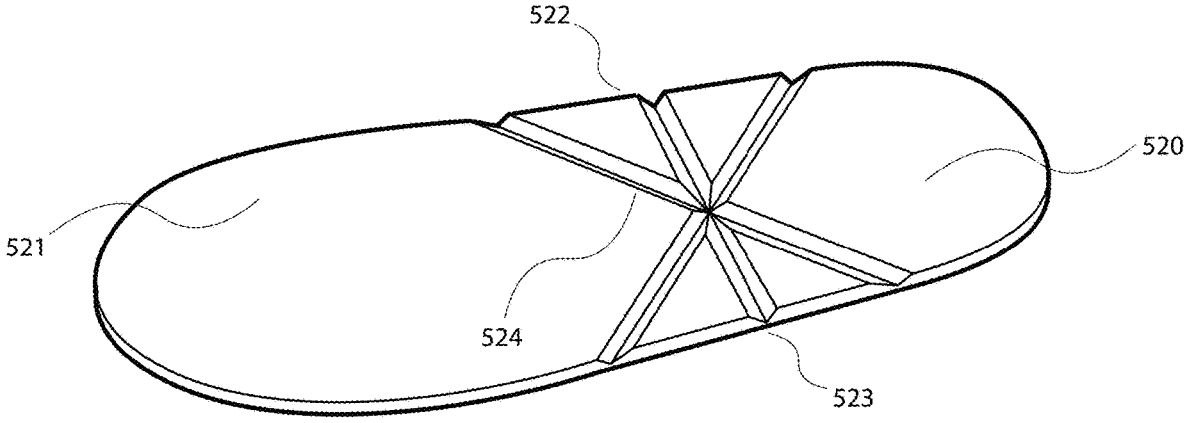
FIG. 7B.1
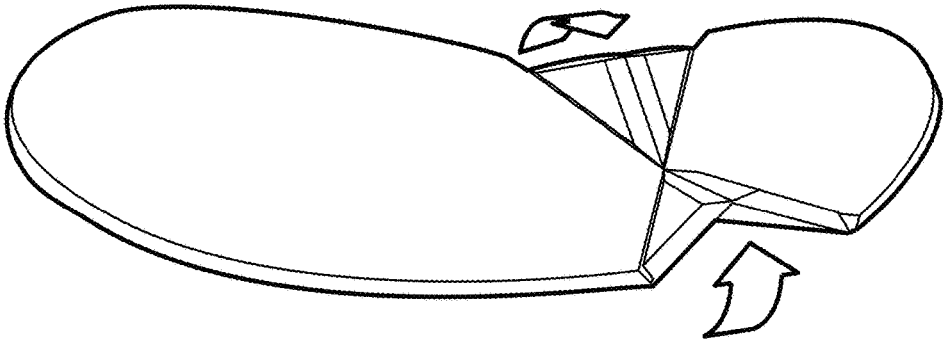
FIG. 7B.2

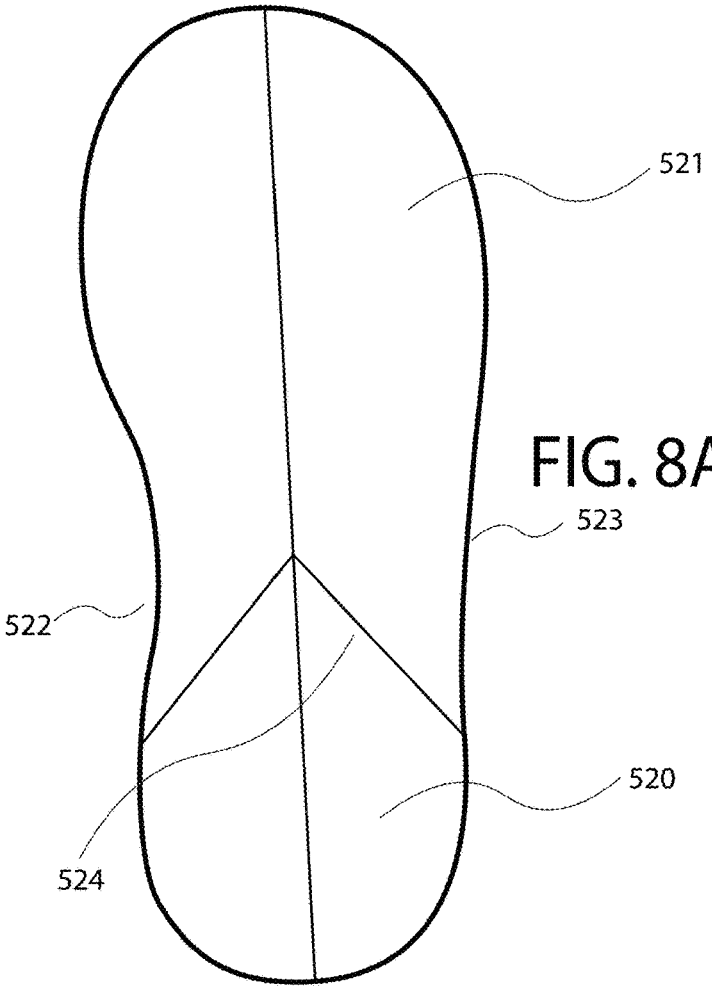
FIG. 8A.1
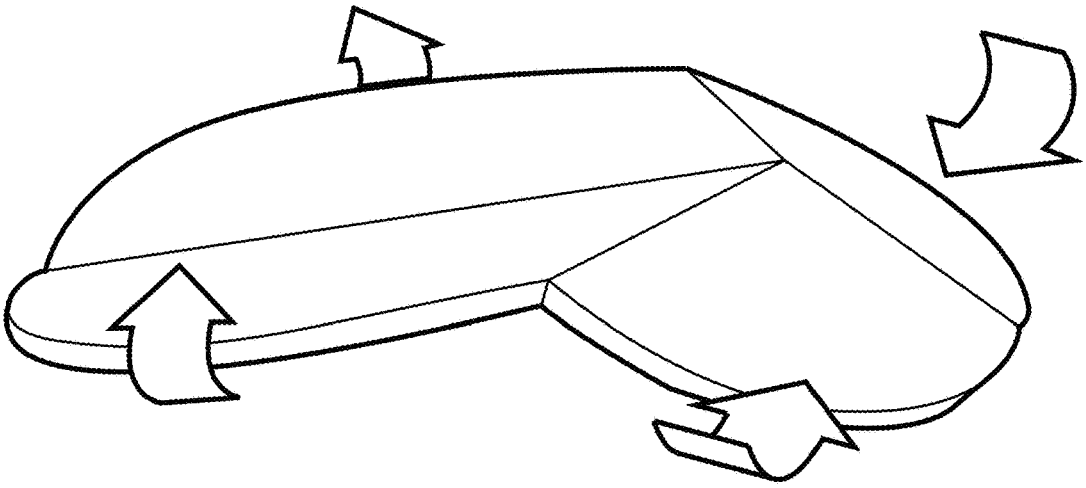
FIG. 8A.2

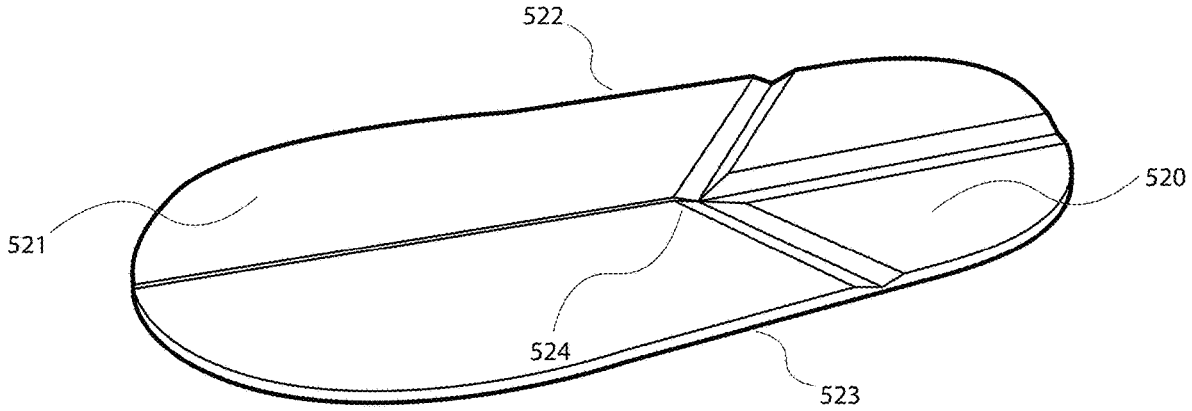
FIG. 8B.1
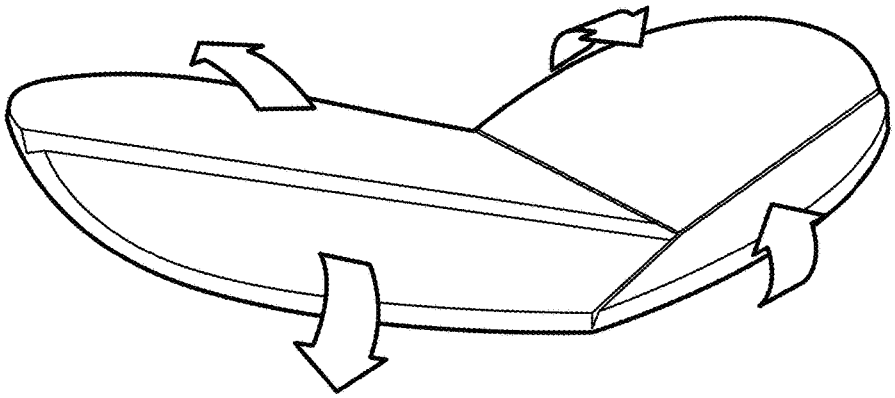
FIG. 8B.2

FIG. 9A.1
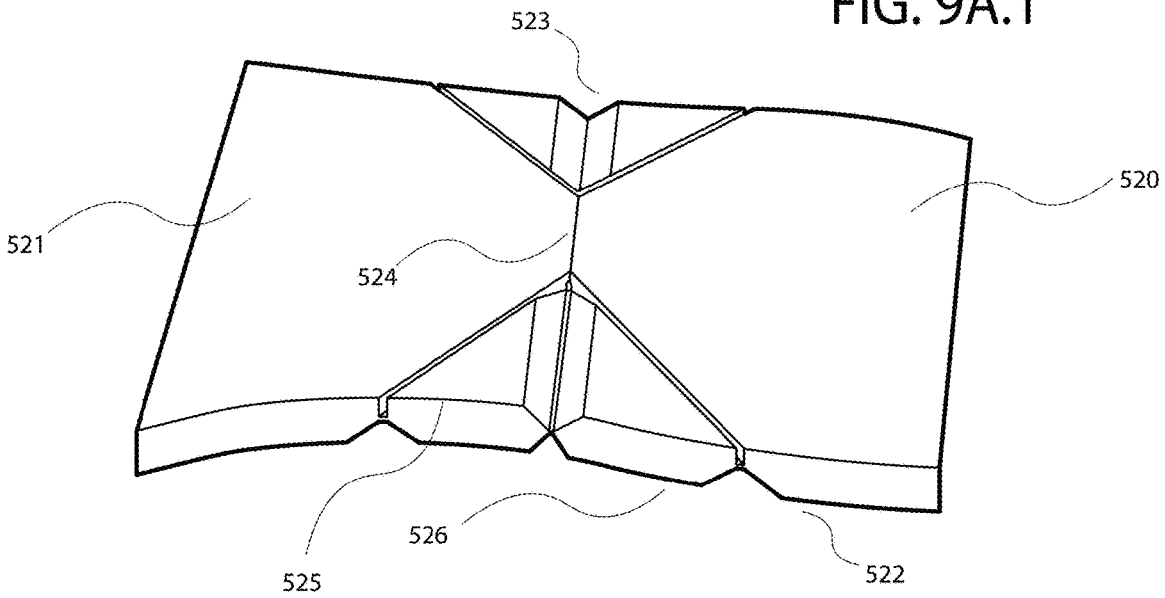
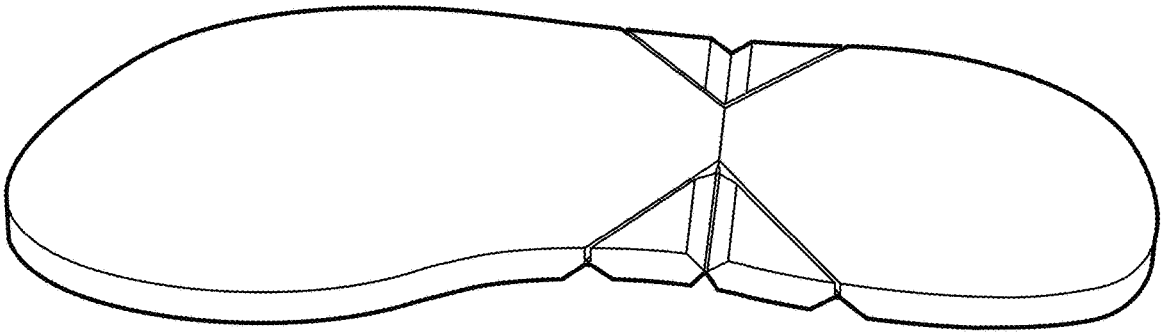
FIG. 9A.2

FIG. 9B.1
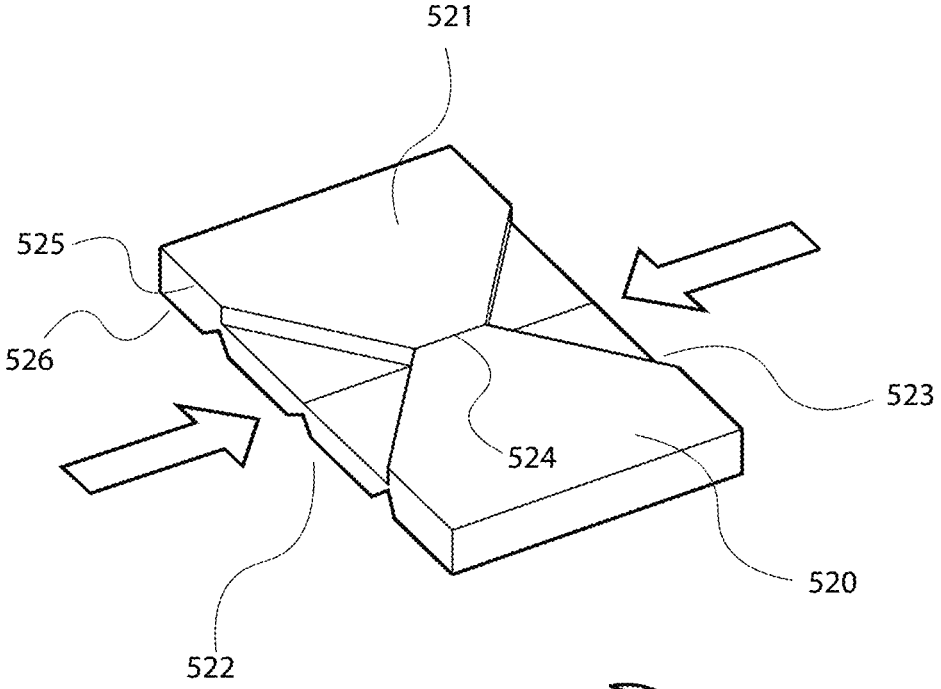
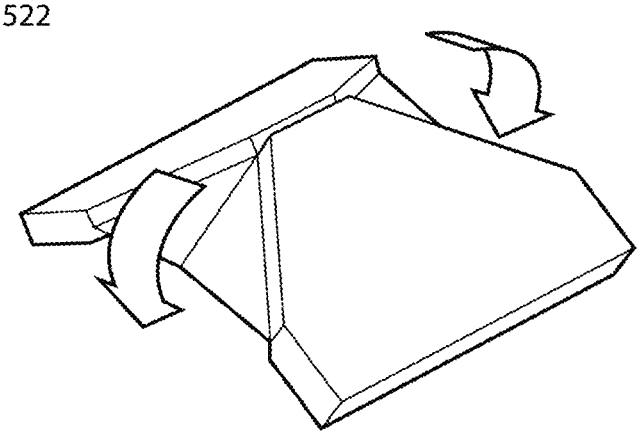
FIG. 9B.2

RAPID-ENTRY FOOTWEAR HAVING AN EXPANDABLE OPENING

CROSS-REFERENCE TO RELATED APPLICATIONS

This application is a continuation of, claims priority to and the benefit of PCT Serial No. PCT/US19/69110 filed Dec. 31, 2019 and entitled RAPID-ENTRY FOOTWEAR HAVING AN EXPANDABLE OPENING. PCT Serial No. PCT/US19/69110 claims the benefit of U.S. Provisional Patent Application No. 62/789,395, filed Jan. 7, 2019 entitled "RAPID-ENTRY FOOTWEAR HAVING AN EXPANDABLE OPENING," and U.S. Provisional Patent Application No. 62/937,107, filed Nov. 18, 2019 entitled "RAPID-ENTRY FOOTWEAR HAVING AN EXPANDABLE OPENING." All of the aforementioned applications are incorporated herein by reference in their entireties.

FIELD

The present disclosure relates to rapid-entry footwear, and more specifically to footwear having a base with a cut-out and/or a fold pattern, either of which, when actuated, is useful to transform the footwear to facilitate donning and doffing.

BACKGROUND

Whether due to inconvenience or inability, donning and doffing of shoes, including tying or otherwise securing the same, and doing the foregoing for others, may be undesirable and/or present difficulties to some individuals. The present disclosure addresses this need.

SUMMARY

Example embodiments of the present disclosure provide for a rapid-entry shoe comprising a medial upper portion coupled with a medial base portion, and a lateral upper portion coupled with a lateral base portion. In an open configuration, the medial upper portion and the lateral upper portion can be disposed apart from one another to provide an expanded shoe opening, and the medial base portion and the lateral base portion can be drawn toward one another. In a closed configuration, the medial upper portion and the lateral upper portion can be positioned adjacent to one another to secure a foot, and the medial base portion and the lateral base portion can be disposed apart from one another.

Example embodiments of the present disclosure also provide for a rapid-entry shoe comprising a base having a forward portion, a rearward portion, a medial side, and a lateral side. Example embodiments further provide for a rapid-entry shoe comprising a waist extending between the medial side and the lateral side of the base, the waist located at the intersection of the forward portion from the rearward portion. The shoe may have a relaxed configuration in which the forward portion and the rearward portion are substantially coplanar around the waist. Application of opposing inward forces parallel to the waist may result in the rapid-entry shoe assuming an actuated configuration in which the rearward portion and the forward portion are folded around, or angled relative to, the waist. An opening of the shoe can be larger in the actuated configuration than in the relaxed configuration. The shoe can be biased toward the relaxed configuration.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

FIGS. 1A and 1B illustrate a rapid-entry shoe in a closed configuration and an open configuration, respectively, according to various embodiments;

FIGS. 3A.1, 2 illustrate top views of an example embodiment of a fold pattern, and FIGS. 3B.1, 2 illustrate bottom views of the example embodiment of FIGS. 3A.1, 2, respectively;

FIGS. 4A.1-4C.3 illustrate various embodiments of a rapid-entry shoe having a fold pattern and an upper comprising a resilient member, the foregoing in actuated and relaxed configurations;

FIGS. 5A.1, 2 illustrate top views of another example embodiment of a fold pattern, and FIGS. 5B.1, 2 illustrate bottom views of the example embodiment of FIGS. 5A.1, 2, respectively;

FIGS. 6A.1, 2 illustrate top views of yet another example embodiment of a fold pattern, and FIGS. 6B.1, 2 illustrate bottom views of the example embodiment of FIGS. 6A.1, 2, respectively;

FIGS. 7A.1, 2 illustrate top views of still another example embodiment of a fold pattern, and FIGS. 7B.1, 2 illustrate bottom views of the example embodiment of FIGS. 7A.1, 2, respectively;

FIGS. 8A.1, 2 illustrate top views of still another example embodiment of a fold pattern, and FIGS. 8B.1, 2 illustrate bottom views of the example embodiment of FIGS. 8A.1, 2, respectively;

FIGS. 9A.1-9B.2 illustrate example embodiments of fold patterns having mass added to the top of the fold pattern as well as to the bottom of the fold pattern;

DETAILED DESCRIPTION

Figure 1C:
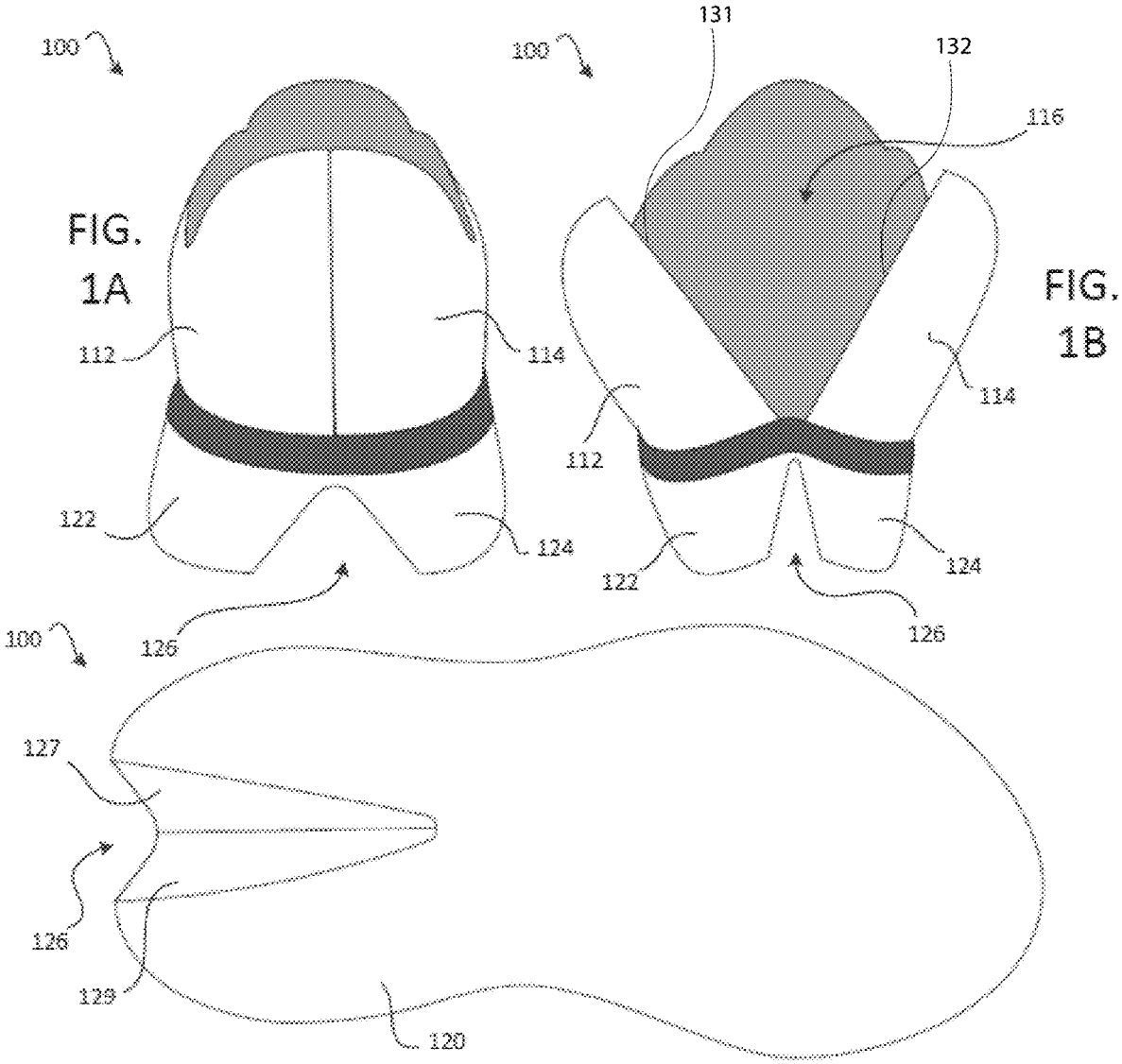
FIG. 1C illustrates a sole of a rapid-entry shoe having a cut-out, in accordance with various embodiments.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

As used herein, a "base" of a rapid-entry shoe refers to an outsole or portions thereof, a midsole or portions thereof, an insole or portions thereof, a wedge or portions thereof, or other suitable structure disposed between and/or adjacent to the foregoing parts of a rapid-entry shoe.

Example embodiments of the present disclosure comprise a rapid-entry shoe 100 having a closed configuration (FIG. 1A) and an open configuration (FIG. 1B). The open configuration has an expanded shoe opening to facilitate reception of a foot of an individual wearing the rapid-entry shoe 100, while the closed configuration has a smaller shoe opening to retain the foot within the rapid-entry shoe 100.

The rapid-entry shoe 100, according to various embodiments, comprises a medial upper portion 112 coupled with a medial base portion 122 (collectively a medial portion). The rapid-entry shoe 100, according to various embodiments, also comprises a lateral upper portion 114 coupled with a lateral base portion 124 (collectively a lateral portion). In various embodiments, the medial portion may be coupled to or integrally formed with the lateral portion at a hinge/pivot location.

In an open configuration (FIG. 1B), edges at the rear of the rapid-entry shoe 100 of the medial upper portion 112 and the lateral upper portion 114 are disposed apart from one another, defining a splay 116 in the upper, thereby providing an expanded shoe opening. In the open configuration, a cut-out 126 defined between the medial base portion 122 and the lateral base portion 124 (which is not necessarily cut out of anything, but instead, could be formed in the first instance as such) is closed or at least narrowed. That is, in the open configuration, the medial base portion and the lateral base portion are drawn toward one another. In example embodiments, an angle defined by cut-out 126 at the rear of the rapid-entry shoe 100 is larger in the open configuration than in the closed configuration.

In the closed configuration (FIG. 1A), edges of the medial upper portion 112 and the lateral upper portion 114 at the rear of the rapid-entry shoe 100 are positioned proximal to (e.g., adjacent to, abutting, overlapping, etc.) one another. That is, in example embodiments, the medial upper portion 112 and the lateral upper portion 114 are drawn together to substantially close the splay 116, with the medial base portion 122 and the lateral base portion 124 disposed apart from one another such that the defined cut-out 126 is wider/larger.

In various embodiments, and with continued reference to FIGS. 1A and 1B, the rapid-entry shoe 100 may, by default, be in the closed configuration (e.g., may be biased toward the closed configuration). Accordingly, a user may need to grasp the base portions 122, 124 and compress them together in order to drive the medial base portion 122 and the lateral base portion 124 closer together (narrowing the cut-out 126), thereby driving the upper portions 112, 114 away from each other to open and expand the splay 116 and thereby expand the shoe opening (through which a user's foot is inserted). In response to releasing the compressive force against the base portions 122, 124, the upper portions 112, 114 may move back towards each other to narrow the splay 116 and to thus facilitate retention of the foot within the rapid-entry shoe 100.

In various embodiments, the rapid-entry shoe 100 may include gripping portions on outside surfaces of the base portions 122, 124 to facilitate the user grasping the base portions 122, 124 of the rapid-entry shoe 100 during the application of a compressive force. For example, the outside surfaces of the base portions 122, 124 may have gripping features or other grasping lips, edges, etc. For example, one or both of the medial base portion 122 and the lateral base portion 124 can comprise a grip tab.

In various embodiments, the rapid-entry shoe 100 may not be biased toward either the open or closed configuration. For example, the rapid-entry shoe 100 may be bi-stable and thus may be configured to have stability in both the open and closed configurations. Said differently, the rapid-entry shoe 100 may remain in the closed configuration until a compressive force is applied to the base portions 122, 124 to transition the shoe to the open configuration, and the rapid-entry shoe 100 may also remain in the open configuration until a compressive force is applied to the upper portions 112, 114 to transition the shoe back to the closed configuration. In various embodiments, instead of the above-mentioned compressive forces, a corresponding expanding force may be applied to the respective portions of the rapid-entry shoe 100 to effectuate the desired position change.

In various embodiments, the upper portions 112, 114 may have securing/engagement features to facilitate holding the rapid-entry shoe 100 in the closed configuration. That is, the upper portions 112, 114 may be detachably coupled together, thereby facilitating secure retention of the foot while the user is wearing/using the shoe. In various embodiments, the medial upper portion 112 and the lateral upper portion 114 are secured to each other via one or more of a magnet, a strap, a buckle, laces, and a hook and loop fastener. For example, medial upper portion 112 may include a first engagement feature 131 and lateral upper portion 114 may include a corresponding second engagement feature 132. These engagement features 131, 132 (e.g., magnets, straps, etc.) may be used to hold the two portions together, for example, along edges of the splay 116.

In various embodiments, and with reference to FIG. 1C, the base 120 of the rapid-entry shoe 100 may define a cut-out or recess 126 (e.g., comprising a wedge or any other elliptical or non-elliptical shape or profile, whether constant or progressive). The defined cut-out 126 may have dimensions (e.g., width and/or depth) that decrease moving from the rear of the rapid-entry shoe 100 toward the front of the rapid-entry shoe 100. The defined cut-out 126 may extend along up to about 50% of the length of the shoe (e.g., may generally only be in the heel portion of the rapid-entry shoe). In various embodiments, the length of the defined cut-out 126, as measured from the rear of the shoe toward the front of the shoe, is less than about 30% of the total length of the shoe. In various embodiments, the cut-out 126 is defined by planar surfaces 127, 129, angled relative to one another. In other embodiments, the cut-out 126 is defined by one or more non-planar surfaces, for example, defined by one or more curves which may or may not be constant. Additional details pertaining to alternative implementations of the base and cut-out are provided below with reference to FIGS. 2A-2E.

In various embodiments, in response to the outsole of the rapid-entry shoe 100 contacting the ground, the rapid-entry shoe 100 may remain in the closed configuration. That is, in various embodiments, contact of an outsole of the rapid-entry shoe 100 with a surface maintains the rapid-entry shoe in the closed configuration such that the rapid-entry shoe 100 is be configured to securely retain the foot within the shoe 100.

In various embodiments, the rapid-entry shoe may include a heel counter member that comprises a medial portion and a lateral portion. The medial portion may include the medial upper portion 112, while the lateral portion may include the lateral upper portion 114. In various embodiments, the medial portion may be coupled to or integrally formed with the lateral portion at a hinge/pivot location. In various embodiments, the heel counter member extends from the base of the shoe to the collar that defines the shoe opening.

Figure 2B:
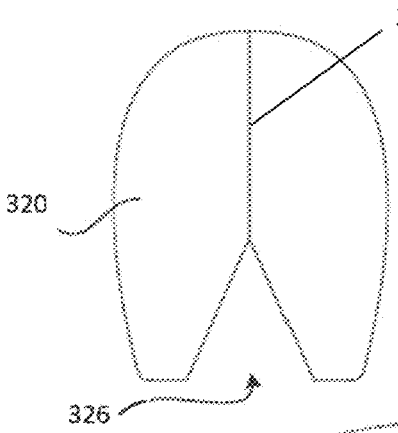
FIGS. 2B-2E illustrate an alternative implementation of a sole portion of a rapid-entry shoe transitioning from a closed configuration to an open configuration, in accordance with various embodiments.
Figure 2C:
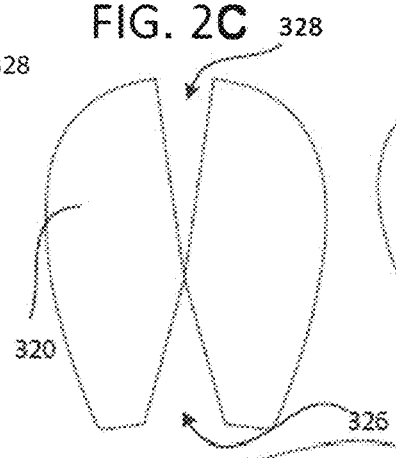
Figure 2D:
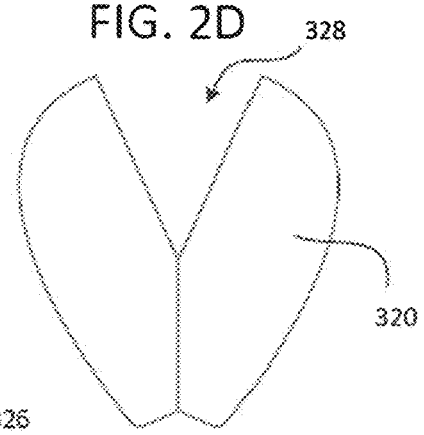
Figure 2A:
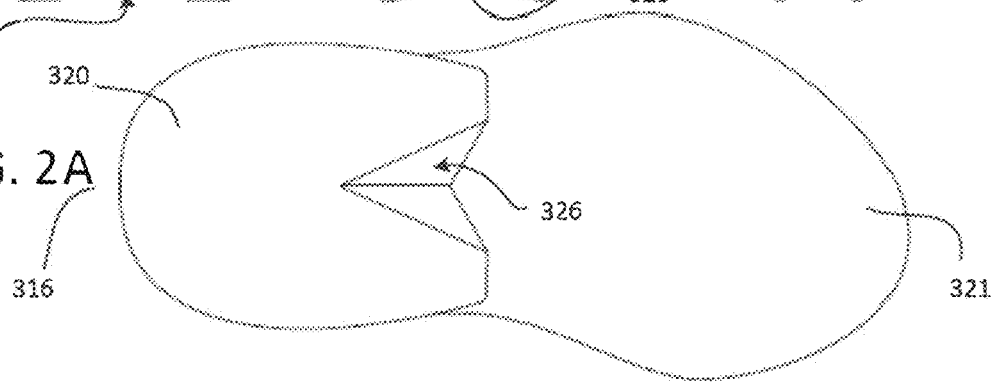
FIG. 2A illustrates another implementation of a sole portion of a rapid-entry shoe.
Figure 2E:
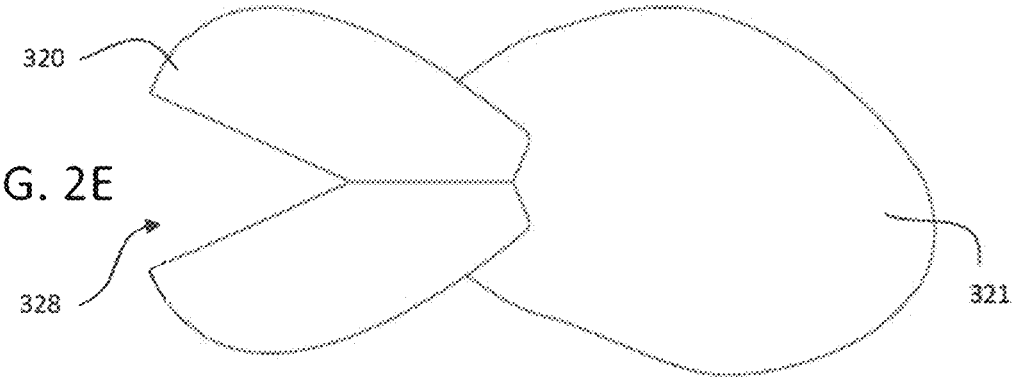

In various embodiments, and with reference to FIG. 2A, the base of the shoe 100 may include a rearward portion 320 and a forward portion 321. In various embodiments, the rearward portion 320 of the base may have a cut-out 326 disposed/defined on a forward side of the rearward portion 320. In other words, instead of disposing the cut-out 126 along the rear edge of the base (as shown and described above), the cut-out 326 may be generally disposed in the middle of the shoe between the heel end and the toe end of the base. This cut-out 326 may be similar in function to the cut-out 126 described above such that compression of the cut-out 326 causes a corresponding expansion of a splay 316 in the rear upper portion of the shoe, similar to splay 116 (FIG. 1B).

In various embodiments, the rapid-entry shoe may have a splay 316 in the upper, as well as a splay in the base, such as splay 328 (FIGS. 2B-2E). Splay 328 may extend from splay 316 through rearward portion 320 of the base. An expanded splay 328 may correspond to the open configuration described above. That is, FIG. 2B may illustrate the shoe in the closed configuration, FIG. 2C may illustrate the shoe in the intermediate position, and FIGS. 2D and 2E may illustrate the shoe in the open configuration. The base comprising splay 328 may be beneath an outsole.

In various embodiments, the rapid-entry shoe may include one or more levers, springs, grips, grasps, handles, or other elements that can be manipulated/actuated by a user to transition the rapid-entry shoe between the closed and open configurations. In various embodiments, instead of compressing and expanding the sides of the upper and/or the sides of the base, the compressing and expanding may be performed along different axes of the shoe. Said differently, the present disclosure is not necessarily limited to implementations in which the compression and expansion is lateral, but instead the compression and expansion movement may be along a forward-to-rear axis of the shoe. For example, the rapid-entry shoe may be configured such that a compressive force applied on the heel end and the toe end of the shoe may trigger an expansion of the shoe-opening.

In accordance with example embodiments of the present disclosure, a rapid-entry shoe comprises a folding base to allow for a larger opening for a foot to enter.

In accordance with example embodiments of the present disclosure, and with reference to FIGS. 3A.1, 2 and 3B.1, 2, a rapid-entry shoe comprises a base having a forward portion 521, a rearward portion 520, a medial side 522, and a lateral side 523. An example rapid-entry shoe further comprises a waist 524 extending all or partially between the medial side 522 and the lateral side 523 of the base, the waist 524 located at the intersection of and/or separating, the forward portion 521 from the rearward portion 520. In example embodiments, the waist 524 comprises a portion of the forward portion 521 and/or the rearward portion 520.

In example embodiments, the forward portion 521 corresponds to all or a portion (see, e.g., 9B.1, 2) of a forefoot portion of an outsole, while a rearward portion 520 corresponds to all or a portion (see again, e.g., 9B.1, 2) of a heel portion of an outsole.

In example embodiments, the waist 524 comprises a fold pattern in the base (which can comprise one or more folds, cutaways, weakened portions or the like). In example embodiments, the waist comprises a plurality of fold patterns in the base. In example embodiments, the waist comprises parallel fold patterns in the base. In example embodiments, the waist comprises orthogonal fold patterns, cutaways and/or weakened portions in the base.

In example embodiments, the waist extends linearly between the medial side and the lateral side of the base. In example embodiments, the waist extends non-linearly between the medial side and the lateral side of the base. In example embodiments, the waist comprises a feature in a base tread of the shoe. Notwithstanding the foregoing, the waist is not merely a feature in a base tread of the shoe, but instead, is foldable to expand an opening, as described herein.

In example embodiments, the waist comprises a forward waist portion (e.g., located on a forward portion 521) and a rearward waist portion (e.g., located on a rearward portion 520). In such embodiments, each of the forward waist portion and the rearward waist portion can comprise a complimentary fold pattern (on its top and/or its bottom surface, as described below). For example, the fold patterns on the forward and rearward waist portions can each comprise a first shape (e.g., a right triangle), that are adjacent to one another, and that combine for form a second shape complementary to and larger than the first shape (e.g., a larger, isosceles or equilateral triangle).

In some embodiments, the shoe has a relaxed configuration in which the forward portion 521 and the rearward portion 520 are substantially coplanar around the waist 524. Stated differently, in some embodiments, a forward portion 521 and a rearward portion 520 each define a plane, and the planes are parallel when the rapid-entry shoe is in a relaxed configuration.

In some embodiments, application of opposing inward forces parallel to the waist 524 results in the shoe assuming an actuated configuration in which the rearward portion 520 and the forward portion 521 are folded around, or angled relative to, the waist 524. In this regard, the rearward portion and the forward portion are angled or curved relative to one another when the shoe is in its actuated configuration, in accordance with some embodiments.

In some embodiments, an opening of the shoe is larger in the actuated configuration than in the relaxed configuration. In some embodiments, the shoe is biased toward the relaxed configuration.

In accordance with example embodiments, a stopping point or other inhibitor is incorporated into the shoe to prevent over rotation from the actuated configuration beyond the relaxed configuration.

In this regard, a shoe in accordance with the present disclosure can comprise a rigidly-foldable base, the base comprising a plurality of folds wherein folding of the base toward a first plane causes relative movement of forward and rearward portions about a second plane orthogonal to the first plane to thereby expand an opening of the shoe.

Example embodiments further provide for a shoe having a rigidly-foldable base, the base comprising a plurality of folds wherein bringing medial and lateral sides toward each other in a first plane brings forward and rearward portions toward each other in a second plane orthogonal to the first plane to thereby expand an opening of the shoe.

Example embodiments further provide for a shoe having a rigidly-foldable base, the base comprising a plurality of folds wherein moving two points on the base closer in a first plane moves two points on a topline of the shoe away from each other in a second plane orthogonal to the first plane to thereby expand an opening of the shoe.

With reference to FIG. 4A.1, 2, when a force is exerted on either side of the waist 524 of an example rapid-entry shoe (e.g., at one or more tabs coupled to the waist 524), motion can be transferred via the fold pattern such that an angle is created between the forward portion 521 of the base and rearward portion 520 of the base. In this actuated configuration, a shoe opening defined by an upper coupled to the base can be expanded. When the force is released, the rapid-entry shoe can return to its relaxed configuration.

With continued reference to FIG. 4A.1, 2, the upper can comprise a resilient member 530 that is deformed in an expanded configuration such that when the force is released, the rapid-entry shoe is drawn toward its relaxed configuration. FIGS. 4B.1, 2, 3 shows support posts 560 that anchor the resilient member 530. The support posts 560 can stem from the base or be included in the upper itself. In this regard, in example embodiments, the shoe is biased toward the relaxed configuration, at least in part, by a resilient member extending between the forward portion and the rearward portion. In example embodiments, the resilient member is attached to the upper of the shoe. In example embodiments, the resilient member is attached to the base of the shoe.

While a resilient member 530 is illustrated, other members are contemplated that bias the shoe toward the relaxed configuration, for example, a flexible shank or elastic band 531 coupled to the top portion of the base, a flexible lasting board, or a portion of the strobel or upper comprising or coupled to an elastic material.

With reference to FIG. 4C.1, 2, 3, in use of an example embodiment, a user squeezes the sides of shoe, creating a larger foot opening. The larger opening makes it easier for a baby or child's foot to slide in. After releasing the sides, the shoe is secure on a baby or child's foot.

FIGS. 3A.1, 2, 5A.1, 2, 6A.1, 2, 7A.1, 2 and 8A.1, 2 depict top views of example embodiments of fold patterns that can be used to transform the forward portion 521 of the base and rearward portion 520 of the base away from each other. FIGS. 3B.1, 2, 5B.1, 2, 6B.1, 2, 7B.1, 2 and 8B.1, 2 depict bottom views of the example embodiments depicted in FIGS. 3A.1, 2, 5A.1, 2, 6A.1, 2, 7A.1, 2 and 8A.1, 2, respectively.

With reference to FIGS. 3A.1, 2 and 3B.1, 2 the fold pattern of waist 524 comprises opposing triangles, one with its base on medial side 522, one with its base on lateral side 523, and a bisecting fold intersecting and separating the opposing triangles.

With reference to FIGS. 5A.1, 2 and 5B.1, 2 the fold pattern of waist 524 comprises opposing trapezoids, one with its base on medial side 522, one with its base on lateral side 523, and two bisecting folds intersecting and separating the opposing trapezoids, the bisecting folds forming a quadrilateral shape (e.g., a square or rectangle shape).

With reference to FIGS. 6A.1, 2 and 6B.1, 2 the fold pattern of waist 524 comprises opposing semi-circles.

With reference to FIGS. 7A.1, 2 and 7B.1, 2 the fold pattern of waist 524 comprises opposing triangles with adjoining apexes, one with its base on medial side 522, one with its base on lateral side 523, and a bisecting fold intersecting the opposing triangles.

With reference to FIGS. 8A.1, 2 and 8B.1, 2 the fold pattern of waist 524 comprises angled folds with adjoining ends.

In example embodiments, mass can be added to the top and/or bottom of the fold pattern. With reference to FIGS. 3B.1, 2, 5B.1, 2, 6B.1, 2, 7B.1, 2 and 8B.1, 2, mass has been added to the bottom of the fold pattern only.

With reference to FIGS. 9A.1, 2 and 9B.1, 2, each of which comprises a fold pattern similar to that of FIG. 3A.1, 2, mass has been added to the top 525 of the fold pattern as well as to the bottom 526 of the fold pattern.

Figure 10C:
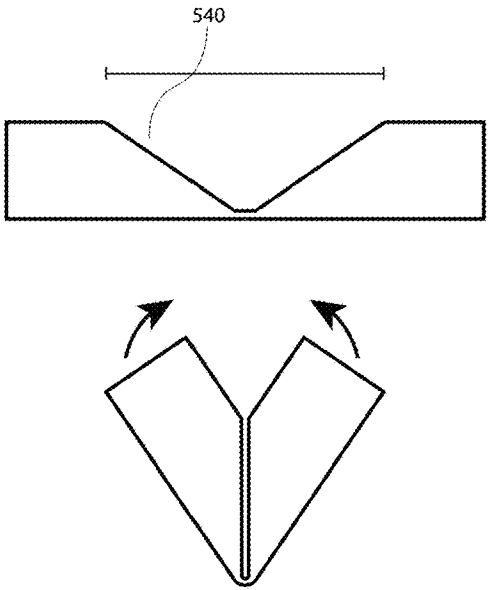
FIGS. 10A-10C illustrate beveled edges of fold patterns of example embodiments.
Figure 10B:
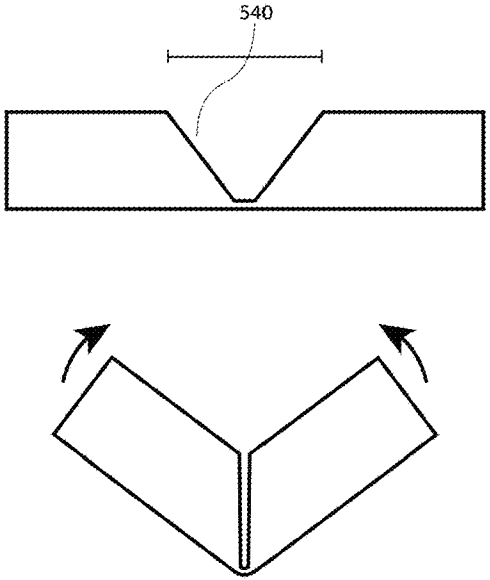
Figure 10A:
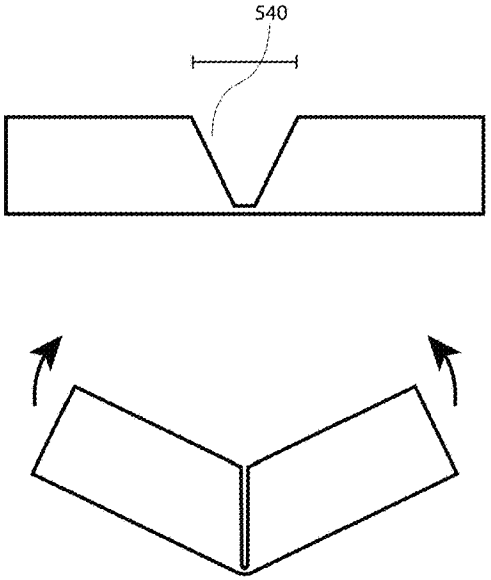

In example embodiments comprises mass added to the top 525 of the fold pattern and/or to the bottom 526 of the fold pattern, the folds can comprise beveled edges 540 so the mass does not prevent itself from folding. FIGS. 10A, 10B, 10C shows how the angle of these beveled edges 540 can control how far the base can bend along a fold line. In example embodiments, the steeper angle of the bevel 540, the less the base can fold before its mass blocks itself, while the less steep angle of the bevel 540, the more the base can fold before its mass blocks itself.

Figure 11:
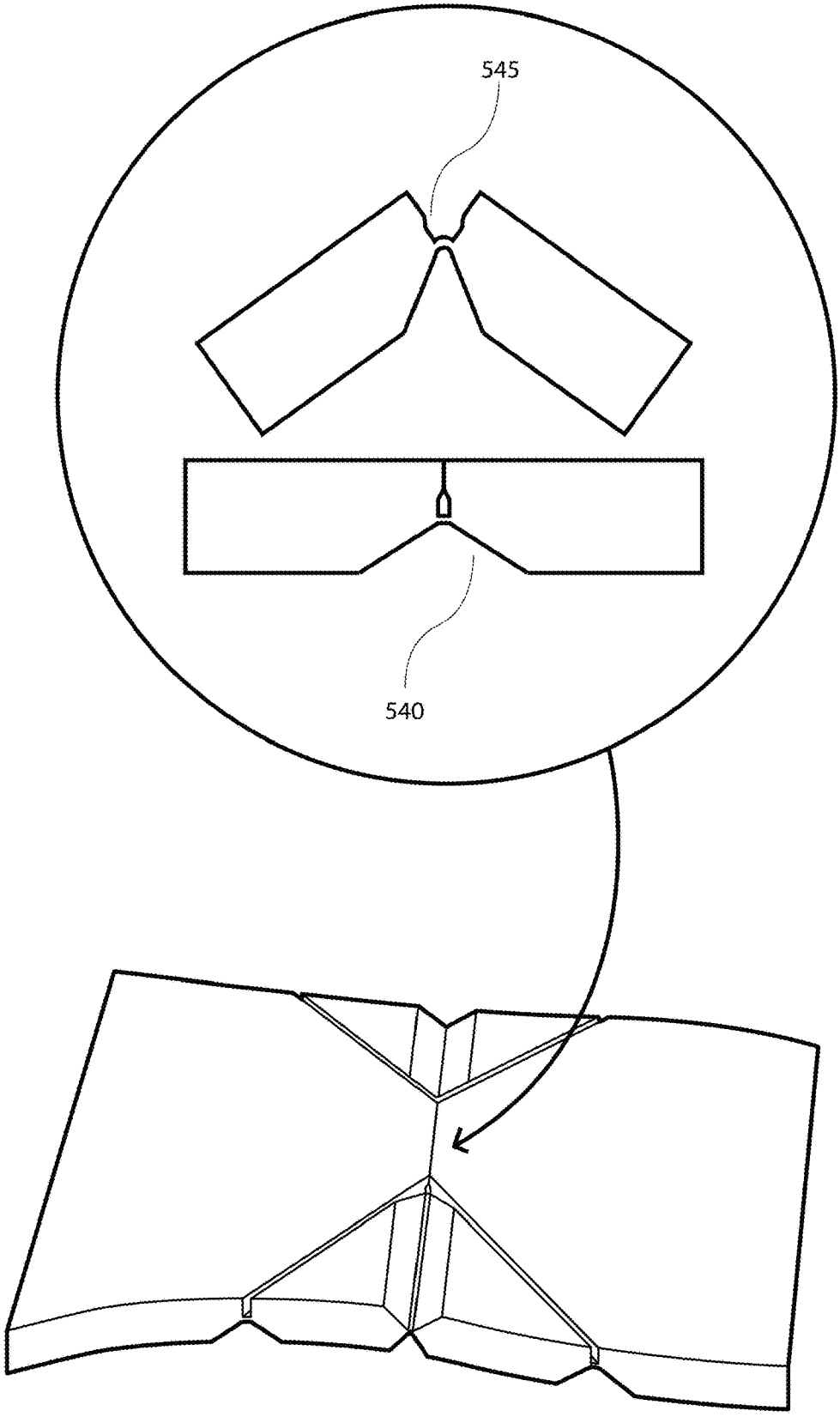
FIG. 11 illustrates straight and beveled edges of a fold pattern of an example embodiment.
Figure 12A:
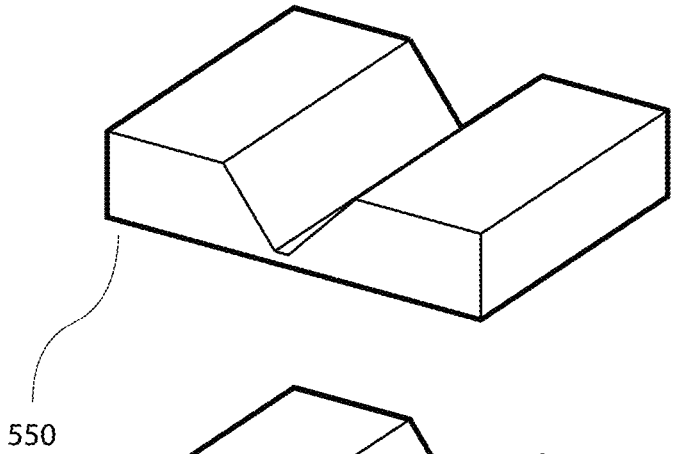
FIGS. 12A-12D illustrate example embodiments of a fold of a fold pattern comprising a living hinge.
Figure 12B:
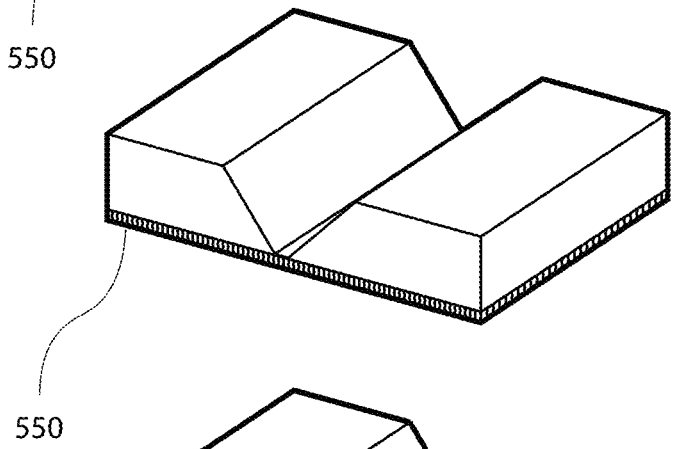
Figure 12C:
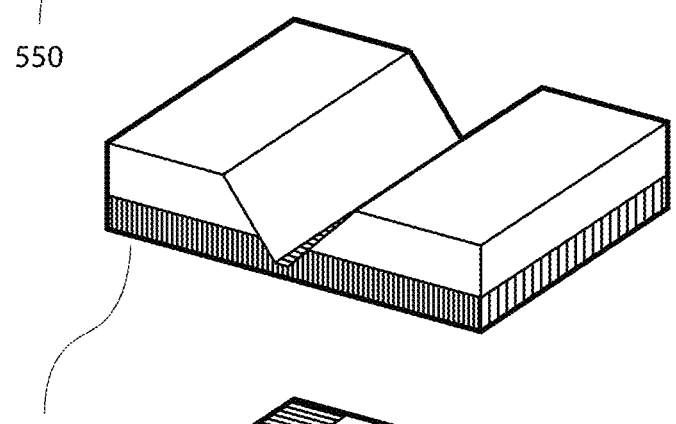
Figure 12D:
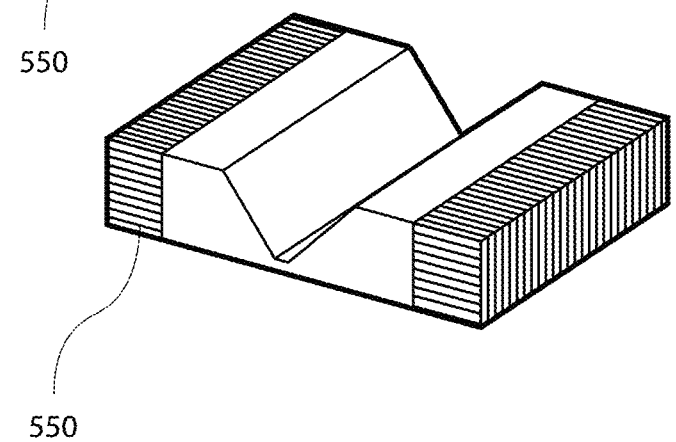
Figure 13A:
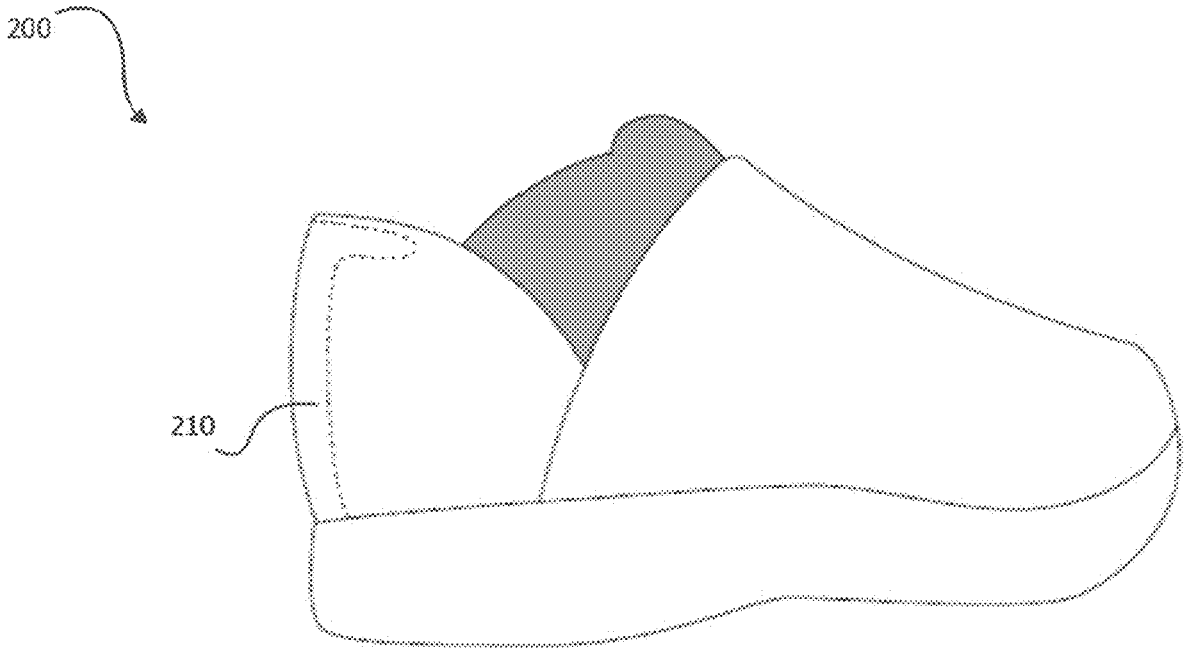
FIGS. 13A and 13B illustrate an alternative implementation of a rapid-entry shoe in a closed configuration and an open configuration, respectively, according to various embodiments.
Figure 13B:
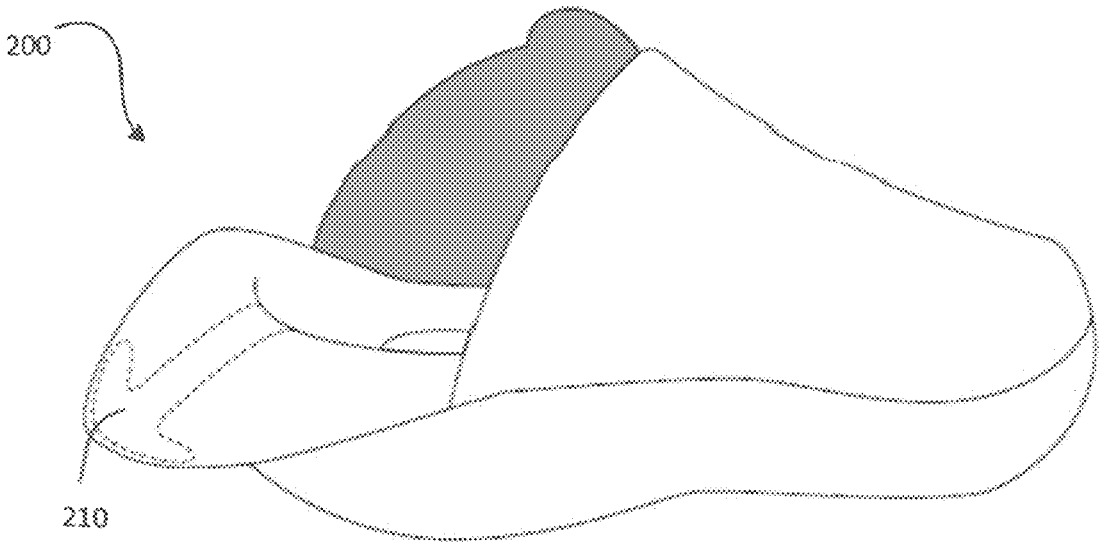

FIG. 11 shows how beveled edges 540 can be used to direct desired folding. If there is a straight edge 545 on either side of the fold line butting up against itself (e.g., any fold bevels are substantially vertical or have an angle of zero or near zero), the base prevents itself from folding upward, while the beveled edge 540 permits the base to fold downward.

In this regard, in accordance with example embodiments, folds on a bottom surface of a fold pattern do comprises beveled edges (and/or comprise beveled edges with less steep angles) to facilitate folding around the bottom surface, while folds on a top surface of a fold pattern do not comprises beveled edges (and/or comprise beveled edges with steeper angles) to prevent folding around the top surface. That is, in example embodiments, the base comprises a fold pattern having fold bevels on a top surface of the base that are steeper than fold bevels on a bottom surface of the base.

FIGS. 12A, 12B, 12C, 12D illustrate additional embodiments of fold patterns comprising living hinges 550 molded into the base. In example embodiments, a living hinge resiliently returns the base from its actuated configuration to its relaxed configuration. The hinge 550 can be comprised of the same material as the rest of the base (e.g., FIG. 12A). The hinge 550 can be comprised of a separate material that the rest of the base is molded or glued to (e.g., FIG. 12B). The material that makes up the hinge 550 can also make up part of the base, with other portions of other materials molded or glued to it.

In various embodiments, and with reference now to FIGS. 13A, 13B, 14A, 14B, and 14C, an alternative implementation of the rapid-entry shoe 200 is provided. The rapid-entry shoe 200 may include a heel counter portion having a resiliently flexible member 210. The resiliently flexible member 210 may extend from the base of the rapid-entry shoe 200 toward a collar portion of the rapid-entry shoe 200. The resiliently flexible member 210 may extend through/within a material that forms a rear upper (e.g., heel counter) of the shoe 200 (FIGS. 13A and 13B) or the resiliently flexible member 210 may form the heel counter itself. In various embodiments, the resiliently flexible member 210 is structurally configured to bend at a specific location. Said differently, the resiliently flexible member 210 may be structurally configured to direct a specific/desired bending action.

The resiliently flexible member 210 may include a collar portion that is coupled to or defines at least a section of the collar of the rapid-entry shoe 200. As mentioned above, the term "collar" generally refers to the portion of the shoe that defines the shoe opening through which a user inserts his/her foot. In an open configuration (FIGS. 13B, 14C), the resiliently flexible member 210 is folded backward away from the shoe opening such that the collar portion is disposed adjacent the sole, thereby expanding the shoe opening. That is, in the open configuration the top, collar portion of the resiliently flexible member 210 (e.g., an engagement member 211) may be disposed below the bottom of the shoe, or at least below the upper portion of the shoe. In a closed configuration (FIGS. 13A, 14A, 14B), the resiliently flexible member 210 is unfolded such that the collar portion is disposed substantially above the sole. For example, in the closed configuration, the resiliently flexible member 210 is substantially straight, or at least is not bent backwards as in the open configuration, thereby helping to securely retain the foot within the shoe 200.

In various embodiments, the rapid-entry shoe 200 may be bi-stable, as described above. That is, the resiliently flexible member 210 may be configured to stably remain in the folded/bended position until a force is exerted to unbend (e.g., re-straighten) the resiliently flexible member 210. Such a force could be imparted by an engagement member 211 extending below the base in the open configuration contacting a surface upon which the rapid-entry shoe is used (e.g., a user taking a step in the rapid-entry shoe). In various embodiments, the rapid-entry shoe 200 also includes one or more tethers 220 coupled on opposing sides of the resiliently flexible member 210 (e.g., on opposing sides of the top, collar portion). The one or more tethers 220 may help maintain the resiliently flexible member 210 in the bi-stable closed configuration. That is, the one or more tethers 220 may bias the resiliently flexible member 210 toward the closed configuration (straight) or the open configuration (curved/bent). For example, if a user attempts to leave the rapid-entry shoe 200 halfway between the open and closed configuration, the one or more tethers 220 may push/pull the resiliently flexible member 210 toward either the open/closed configuration. The one or more tethers 220 may comprise an elastic or resiliently deformable material. In accordance with example embodiments, a stopping point or other inhibitor is incorporated into the shoe to prevent over rotation from the open configuration beyond the closed configuration.

Figure 14A:
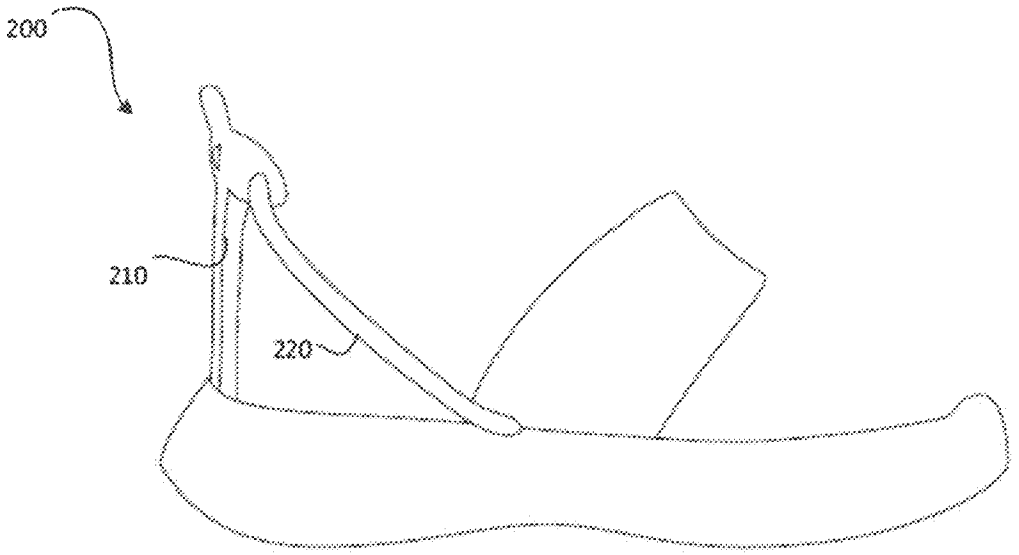
FIGS. 14A and 14B illustrate a rapid-entry shoe in a closed configuration, in accordance with various embodiments.
Figure 14B:
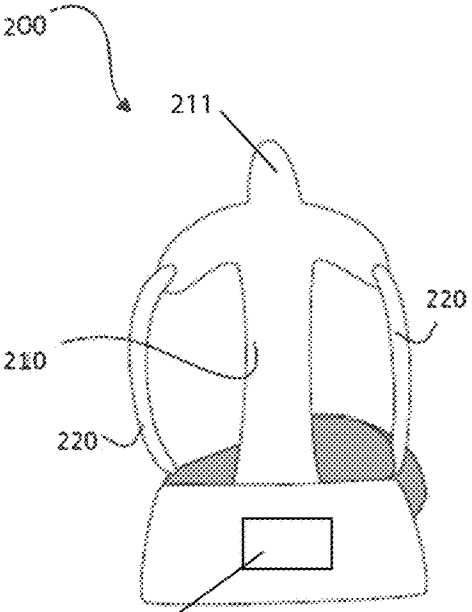
Figure 14C:
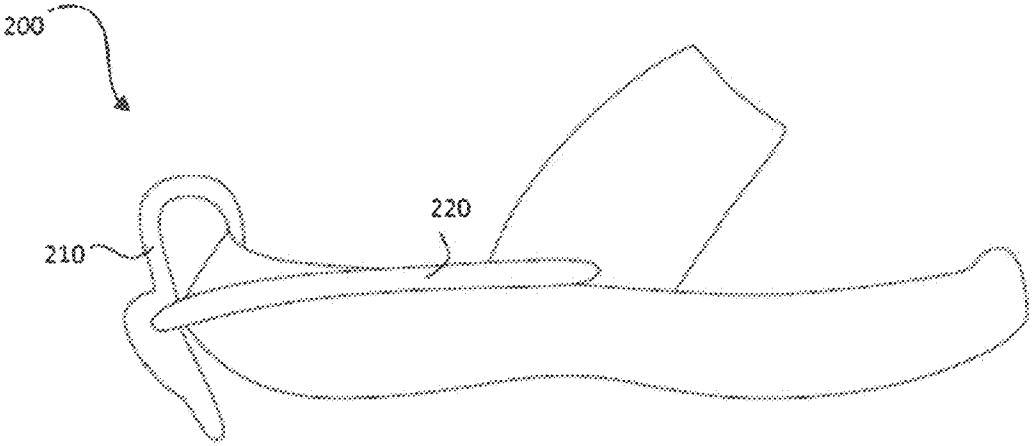
FIG. 14C illustrates a rapid-entry shoe in an open configuration, in accordance with various embodiments.

In various embodiments, and with specific reference to FIGS. 14B and 14C, the collar portion of the resiliently flexible member 210 comprises a first engagement member 211 that is configured to be detachably coupled to a second engagement member 212 at the sole of the rapid-entry shoe 200 in order to temporarily hold the rapid-entry shoe 200 in the open configuration. In various embodiments, the resiliently flexible member 210 may include an overmold or other polymer or textile covering (including the shoe upper or a portion thereof) to minimize discomfort experienced by an individual wearing the shoe.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A rapid-entry shoe comprising:

a base having a forward portion, a rearward portion, a medial side, and a lateral side; and a waist extending between the medial side and the lateral side of the base, the waist located between the forward portion and the rearward portion, the waist comprising a fold pattern in the base, and the fold pattern having a plurality of folds, wherein the plurality of folds comprises a first fold that is angled relative to a second fold;

wherein the rapid-entry shoe has a relaxed configuration in which the forward portion and the rearward portion are substantially coplanar around the waist;

wherein the rapid-entry shoe has an actuated configuration in which the rearward portion and the forward portion are folded around, or angled relative to, the waist about a plane;

wherein the waist is configured such that moving two points closer to each other within the plane results in the rapid-entry shoe assuming the actuated configuration; and wherein an opening of the rapid-entry shoe is larger in the actuated configuration than in the relaxed configuration.

2. The rapid-entry shoe of claim 1, wherein the rapid-entry shoe is configured such that folding of at least one fold of the plurality of folds in the waist results in the rapid-entry shoe assuming the actuated configuration.

3. The rapid-entry shoe of claim 1, wherein the plurality of folds form opposing triangles, one with its base on the medial side, one with its base on the lateral side, wherein the fold pattern further comprises a bisecting fold intersecting the opposing triangles.

4. The rapid-entry shoe of claim 3, wherein the rapid-entry shoe is configured such that actuation of the bisecting fold results in the rapid-entry shoe assuming the actuated configuration.

5. The rapid-entry shoe of claim 1, wherein the plurality of folds form opposing trapezoids, one with its base on the medial side, one with its base on the lateral side, wherein the fold pattern further comprises two bisecting folds intersecting the opposing trapezoids.

6. The rapid-entry shoe of claim 5, wherein actuation of the two bisecting folds results in the rapid-entry shoe assuming the actuated configuration.

7. The rapid-entry shoe of claim 1, wherein a resilient member is coupled to the rapid-entry shoe, the resilient member configured to bias the rapid-entry shoe toward the relaxed configuration.

8. A rapid-entry shoe comprising:

a rigidly-foldable base having a forward portion and a rearward portion, the rigidly-foldable base comprising a fold pattern;

wherein the shoe has a relaxed configuration in which the forward portion and the rearward portion are substantially coplanar;

wherein the shoe has an actuated configuration in which the rearward portion and the forward portion are angled or curved relative to one another about an axis;

wherein an opening of the shoe is larger in the actuated configuration than in the relaxed configuration;

wherein the rigidly-foldable base is configured such that application of opposing inward forces substantially parallel with the axis results in the rapid-entry shoe assuming the actuated configuration; and wherein the shoe is biased toward the relaxed configuration.

9. The rapid-entry shoe of claim 8, wherein the fold pattern comprises fold bevels on a top surface of the rigidly-foldable base that are steeper than fold bevels on a bottom surface of the rigidly-foldable base and wherein the fold bevels on the top surface of the rigidly-foldable base are substantially vertical.

10. The rapid-entry shoe of claim 8, wherein the fold pattern comprises opposing triangles, one with its base on the medial side, one with its base on the lateral side, and a bisecting fold intersecting and separating the opposing triangles.

11. The rapid-entry shoe of claim 8, wherein the fold pattern comprises opposing trapezoids, one with its base on the medial side, one with its base on the lateral side, and two bisecting folds intersecting and separating the opposing trapezoids.

12. The rapid-entry shoe of claim 8, wherein the fold pattern comprises opposing semi-circles.

* * * * *